US009475301B2

(12) United States Patent
Yamada et al.

(10) Patent No.: US 9,475,301 B2
(45) Date of Patent: Oct. 25, 2016

(54) PROTECTION MEMBER FOR LIQUID SUPPLY UNIT

(71) Applicant: SEIKO EPSON CORPORATION, Tokyo (JP)

(72) Inventors: Manabu Yamada, Matsumoto (JP); Noriaki Okazawa, Shiojiri (JP); Tadahiro Mizutani, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/674,926

(22) Filed: Mar. 31, 2015

(65) Prior Publication Data

US 2015/0284159 A1 Oct. 8, 2015

(30) Foreign Application Priority Data

Apr. 7, 2014 (JP) ..... 2014-078347

(51) Int. Cl.
*B41J 2/175* (2006.01)
*B65D 59/06* (2006.01)
*B65D 61/00* (2006.01)

(52) U.S. Cl.
CPC ..... *B41J 2/1754* (2013.01); *B41J 2/17503* (2013.01); *B41J 2/17533* (2013.01); *B41J 2/17536* (2013.01); *B65D 59/06* (2013.01); *B65D 61/00* (2013.01)

(58) Field of Classification Search
CPC B41J 2/17533; B41J 2/17536; B41J 2/1754; B41J 2/17503; B65D 59/06; B65D 61/00
See application file for complete search history.

(56) References Cited

U.S. PATENT DOCUMENTS 5,262,802 A * 11/1993 Karita ..... B41J 2/17513 347/87
5,831,652 A 11/1998 Hinami et al.
5,936,740 A * 8/1999 Fukazawa ..... B41J 2/1752 347/263
6,283,587 B1 * 9/2001 Umemura ..... B41J 2/17533 347/86
6,511,153 B1 * 1/2003 Ishikawa ..... B41J 2/1652 347/35
2001/0017640 A1 * 8/2001 Inada ..... B41J 2/17513 347/84

(Continued)

FOREIGN PATENT DOCUMENTS

CN 200939736 Y 8/2007
EP 0418828 A1 3/1991

(Continued)

*Primary Examiner* — Justin Seo
(74) *Attorney, Agent, or Firm* — Stroock & Stroock & Lavan LLP

(57) ABSTRACT

There is provided a protection member configured to protect a liquid supply unit air-tightly. A cartridge 100 has an ink supply port 112 formed in a bottom surface 101 and an air hole 128 formed in a top surface 102. A protection member 200 is configured to be attachable to the cartridge 100. The protection member 200 includes a film member 201 configured to seal the air hole 128, and a cap section 220 configured to seal the ink supply port 112. The cap section 220 has a columnar support portion 232 having an upper end surface 235 which the film member 201 is joined with. The columnar support portion 232 is provided in an area opposed to a left side surface 105 of the cartridge 100.

16 Claims, 18 Drawing Sheets

(56) References Cited

U.S. PATENT DOCUMENTS

| | | | | |
|---|---|---|---|---|
| 2001/0032927 | A1* | 10/2001 | Fukazawa | B41J 2/1752 250/239 |
| 2002/0118248 | A1* | 8/2002 | Inoue | B41J 2/17503 347/37 |
| 2003/0222940 | A1 | 12/2003 | Seino et al. | |
| 2005/0001888 | A1 | 1/2005 | Seino et al. | |
| 2005/0099471 | A1* | 5/2005 | Mukai | B41J 2/17533 347/84 |
| 2006/0164482 | A1* | 7/2006 | Katayama | B41J 2/17509 347/86 |
| 2007/0206076 | A1 | 9/2007 | Seino et al. | |
| 2009/0251514 | A1 | 10/2009 | Causey et al. | |
| 2013/0286113 | A1* | 10/2013 | Hoff | B41J 2/17536 347/86 |
| 2013/0314477 | A1* | 11/2013 | Nozawa | B41J 2/17553 347/86 |
| 2015/0165777 | A1* | 6/2015 | Mizutani | B41J 2/1752 347/85 |

FOREIGN PATENT DOCUMENTS

| | | | |
|---|---|---|---|
| EP | 0698497 | A2 | 2/1996 |
| EP | 0861732 | A2 | 9/1998 |
| EP | 1065061 | A2 | 1/2001 |
| FR | 2837422 | A1 | 9/2003 |
| JP | 08-230205 | A | 9/1996 |
| JP | 2000-255082 | A | 9/2000 |
| JP | 2003320685 | A | 11/2003 |
| JP | 2005329727 | A | 12/2005 |
| JP | 2006-021476 | A | 1/2006 |
| JP | 3169008 | U | 7/2011 |

* cited by examiner

PROTECTION MEMBER FOR LIQUID SUPPLY UNIT

CROSS-REFERENCE TO RELATED APPLICATIONS

This application claims priority to Japanese Patent Application No. (JP) 2014-78347 filed on Apr. 7, 2014 entire disclosure of which is incorporated herein by reference for all purposes.

BACKGROUND

1. Technical Field

The present invention relates to a protection member for liquid supply unit.

2. Description of the Related Art

A known liquid supply unit includes an ink cartridge configured to supply ink to an inkjet printer. The inkjet printer (hereinafter simply called "printer") is one type of a liquid ejection device and is provided as a printing device to eject ink droplets on a printed surface and thereby form an image. The ink cartridge is detachably mounted on a carriage included in the printer.

The ink cartridge has an ink supply port and an air hole arranged to communicate with an ink chamber which is a part containing an ink in the ink cartridge. The ink cartridge is configured to supply ink to a print head equipped on the carriage via the ink supply port while introducing the air through the air hole into the ink chamber.

The ink cartridge in the unused stage prior to attachment to the printer, for example, during market circulation is generally protected by a protection member attached to the ink cartridge. The protection member serves to seal the ink supply port and the air hole air-tightly, in order to prevent the air from flowing into the ink chamber. JP 2006-021476A discloses a cap member having a tape provided to seal the air hole and a seal member provided to seal the ink supply port, as the protection member of the ink cartridge.

In the course of detachment of the protection member from the ink cartridge, it is desirable to release the sealing of the ink supply port after release of the sealing of the air hole. This configuration suppresses the air from being introduced into the ink chamber not via the air hole but via the ink supply port and thereby suppresses the air from being accumulated in a specific area of the ink chamber near to the ink supply port to interfere with the outflow of ink.

The cap member described in JP 2006-021476A is configured to release the engagement of the seal member with the ink cartridge by pulling the tape to be separated from the air hole. This proposed cap member, however, requires the user to pull the tape until release of the engagement of the seal member and is thus likely to have a problem such as tear of the tape in the middle. The proposed cap member also has the complicated configuration by cooperation of the tape with the engagement part of the seal member. There is accordingly still a room for improvement in the configuration of specifying the sequence of releasing the sealing of the air hole and the sealing of the ink supply port in the course of detachment of the protection member from the ink cartridge.

SUMMARY

In order to solve at least part of the problems described above, the invention may be implemented by aspects described below.

(1) According to one aspect of the invention, there is provided a protection member configured to be attachable to a liquid supply unit. The liquid supply unit may have a first wall surface, a second wall surface opposed to the first wall surface, a third wall surface arranged between the first wall surface and the second wall surface, and a fourth wall surface arranged between the first wall surface and the second wall surface to be adjacent to the third wall surface. The first wall surface may have a liquid supply port which a liquid is flowed through, the second wall surface may have an air hole which the air is flowed through, and the fourth wall surface may have an engagement structure. The protection member attachable to the liquid supply unit may comprise a cap member and a seal member. The map member may be configured to seal the liquid supply port, and the seal member may be configured to seal the air hole. The cap member may have a supporting structure including a joint part which the seal member is joined with. At least part of the supporting structure may be provided in an area opposed to the third wall surface in a state that the protection member is attached to the liquid supply unit. The protection member of this aspect having the simple configuration may specify the sequence of releasing the sealing of the air hole and the sealing of the liquid supply port in the course of detachment of the protection member from the liquid supply unit. For example, the user may readily remove the cap member by simply pressing the supporting structure after removal of the seal member.

(2) In the protection member of the above aspect, the cap member may comprise: a sealing wall section configured to have a sealing element arranged to seal the liquid supply port; an end wall configured to have the supporting structure and arranged to be in contact with the fourth wall surface of the liquid supply unit in the state that the protection member is attached to the liquid supply unit; and a connecting section configured to connect the sealing wall section with the end wall and serve as a supporting point of rotational motion of the end wall in a direction away from the fourth wall surface. In the protection member of this aspect, the seal member may serve to restrict the rotational motion of the end wall. This may accordingly suppress the sealing of the liquid supply port from being released prior to release of the sealing of the air hole in the course of detachment of the protection member.

(3) In the protection member of the above aspect, the cap member may comprise: a first side wall arranged to intersect with the sealing wall section and to be in contact with the third wall surface of the liquid supply unit in the state that the protection member is attached to the liquid supply unit; and a second side wall arranged to intersect with the sealing wall section and to be opposed to the first side wall. The end wall and the first side wall may be away from each other across a first interval, and the end wall and the second side wall may be away from each other across a second interval. The configuration of the protection member of this aspect may enhance the fixation of the protection member to the liquid supply unit and facilitate the rotational motion of the end wall.

(4) In the protection member of the above aspect, the end wall may comprise a first end wall, and the cap member may have a second end wall located at a position opposed to the first end wall across the sealing wall section. In a plan view of the protection member in a direction toward the sealing wall section, with respect to a direction from the first end wall toward the second end wall, a distance La from the joint part of the supporting structure to the second end wall and a distance Lb from the connecting section to the second end wall may satisfy a relation of La≥Lb. The configuration of the protection member of this aspect may specify the small radius of rotation of the end wall and accordingly enhance the restraining force in rotational motion of the end wall by the seal member.

(5) In the protection member of the above aspect, in a plan view of the protection member in a direction toward the third wall surface in the state that the protection member is attached to the liquid supply unit, an angle θ of a direction from the supporting point of the rotational motion of the end wall toward the joint part with respect to the sealing wall section may be in a range of 70 degrees≤θ≤110 degrees. The configuration of the protection member of this aspect may enhance the restraining force in rotational motion of the end wall by the seal member via the supporting structure.

(6) In the protection member of the above aspect, the angle θ may be in a range of 80 degrees≤θ≤100 degrees. The configuration of the protection member of this aspect may further enhance the restraining force in rotational motion of the end wall by the seal member via the supporting structure.

(7) In the protection member of the above aspect, the end wall may comprise: an engaged element to be engaged with the engagement structure; and an operating portion configured to change positions of the engaged element and the supporting structure relative to the liquid supply unit. The configuration of the protection member of this aspect may enhance the fixation of the protection member to the liquid supply unit and facilitate the operation of detachment from the liquid supply unit.

(8) In the protection member of the above aspect, in a plan view of the protection member in a direction toward the end wall, the operating portion may be formed at a position offset to the supporting structure side. The protection member of this aspect may restrict the operation of the operating portion associated with restriction of the motion of the supporting structure by the seal member. Accordingly this configuration may suppress the user's improper operation in the course of detachment of the protection member from the liquid supply unit.

(9) In the protection member of the above aspect, a distance from the connecting section to the joint part may be longer than a distance from the connecting section to the operating portion. The configuration of the protection member of this aspect may enhance the restraining force in rotational motion of the end wall by the seal member via the supporting structure and suppress the sealing of the liquid supply port from being released by an improper operation of the operating portion.

(10) In the protection member of the above aspect, in a direction of attachment of the protection member to the liquid supply unit, a distance from the sealing wall section to the operating portion may be longer than a distance from the sealing wall section to the engaged element and may be shorter than a distance from the sealing wall section to the joint part. The configuration of the protection member of this aspect may enhance the restraining force in rotational motion of the end wall by the seal member to be greater than the force required to release the sealing by the operating portion.

(11) In the protection member of the above aspect, the connecting section may have a hinge structure to rotate the end wall. The configuration of the protection member of this aspect may facilitate the rotational motion of the end wall.

All the plurality of components included in the aspects of the invention described above are not essential, but some components among the plurality of components may be appropriately changed, omitted or replaced with other components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the invention described above may be combined with part or all of the technical features included in another aspect of the invention described later to provide still another independent aspect of the invention.

The invention may be implemented by any of various other aspects: for example, a liquid supply unit with a protection member attached thereto, a detachment method and an attachment method of a protection member from a liquid supply unit, a method of wrapping a liquid supply unit and a method of protecting a liquid supply unit.

DESCRIPTION OF EMBODIMENTS

A. First Embodiment

Figure 1:
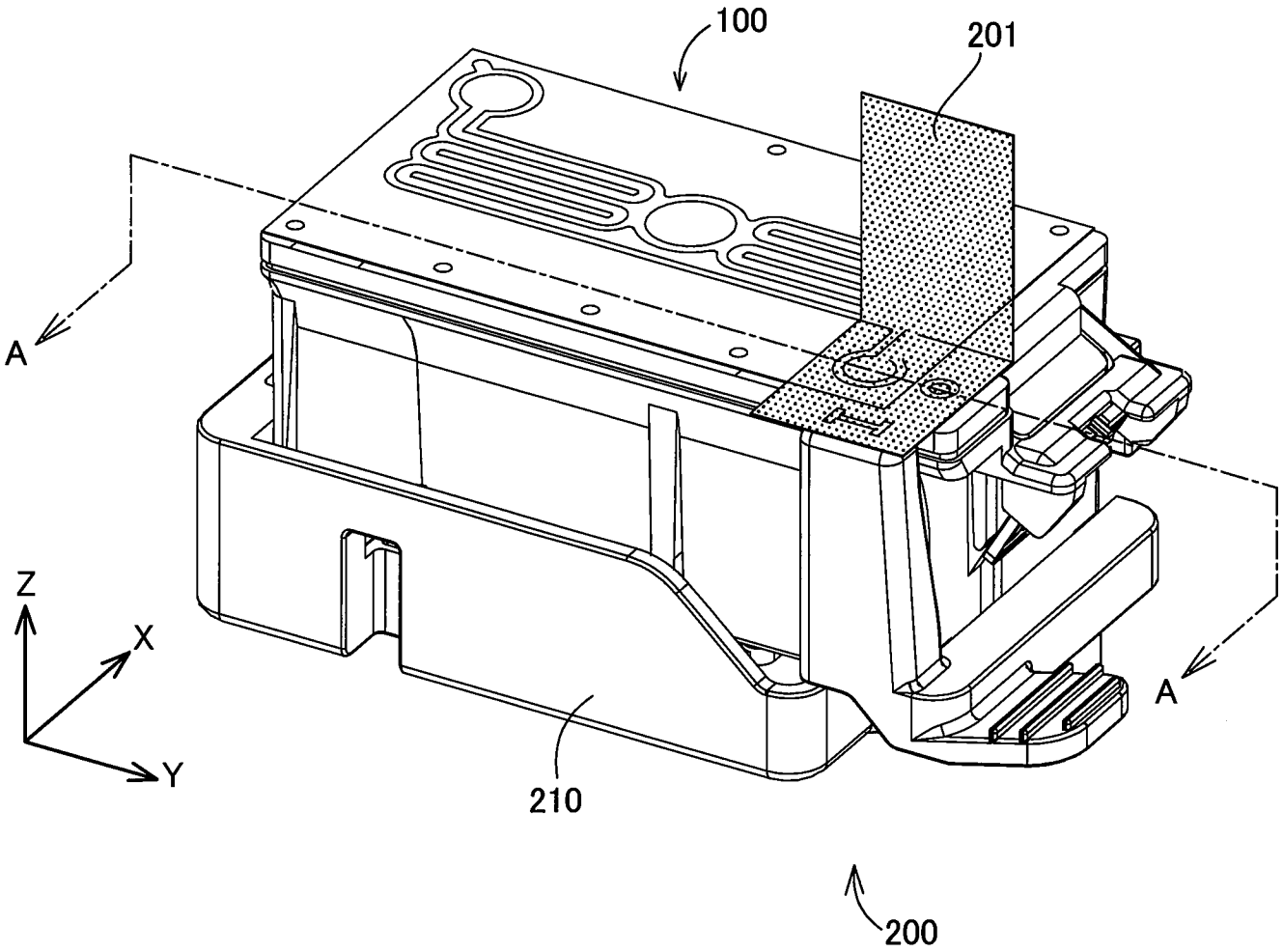
FIG. 1 is a schematic perspective view illustrating the state that a protection member according to a first embodiment of the invention is attached to an ink cartridge.

FIG. 1 is a schematic perspective view illustrating the state that a protection member according to a first embodiment of the invention is attached to an ink cartridge (hereinafter may be simply referred to as "cartridge") as a liquid supply unit. FIG. 1 includes illustration of arrows X, Y and Z representing three directions orthogonal to one another with respect to a cartridge 100. The respective arrows X, Y and Z correspond to arrows X, Y and Z shown in the drawings used for the subsequent description. The directions indicated by the respective arrows X, Y and Z will be described later.

The cartridge 100 is detachably mounted to a carriage (illustration and detailed description are omitted) of an inkjet printer (hereinafter may be simply referred to as "printer") to supply ink to the printer. A protection member 200 is attached to the unused cartridge 100 before factory shipment and is detached by the user before the cartridge 100 is mounted on the carriage of the printer.

The protection member 200 includes a film member 201 and a holder structure 210. The film member 201 corresponds to the seal member and serves to seal an air hole (described later) of the cartridge 100. The holder structure 210 corresponds to the cap member and serves to seal an ink supply port (described later) of the cartridge 100. The film member 201 is joined with an area of the holder structure 210 (described later) corresponding to the supporting structure. Attachment of the protection member 200 causes ink to be sealed in the cartridge 100 and accordingly allows for long-term preservation of the ink quality. The cartridge 100 having the protection member 200 attached thereto may thus be regarded as liquid preservation unit.

The protection member 200 is configured such that the sealing of the ink supply port by the holder structure 210 is released after release of the sealing of the air hole by the film member 201 when the protection member 200 is detached from the cartridge 100. The following describes the structure of the cartridge 100 and subsequently the structure of the protection member 200 and the method of detachment.

[Structure of Cartridge]

Figure 2:
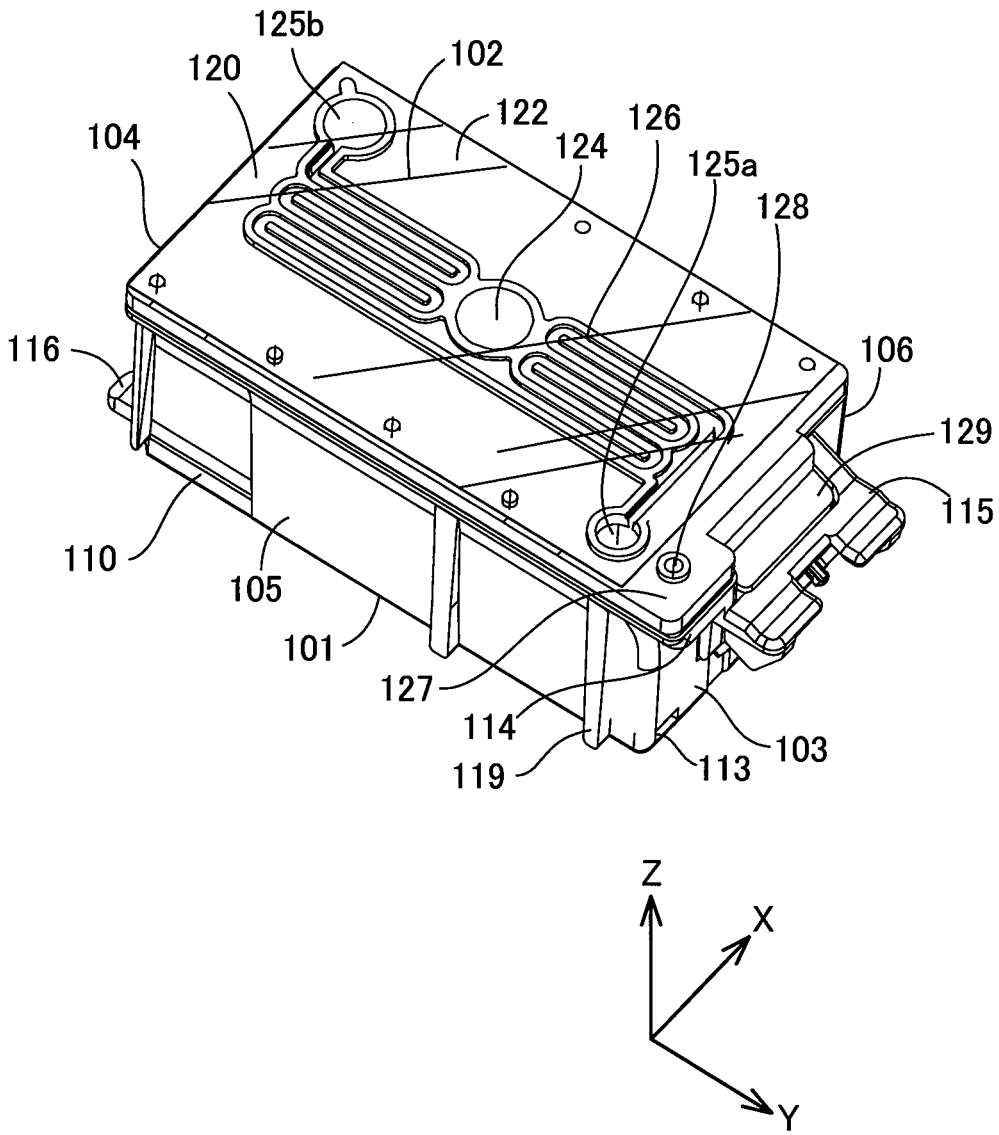
FIG. 2 is a downward perspective view illustrating the ink cartridge.
Figure 3:
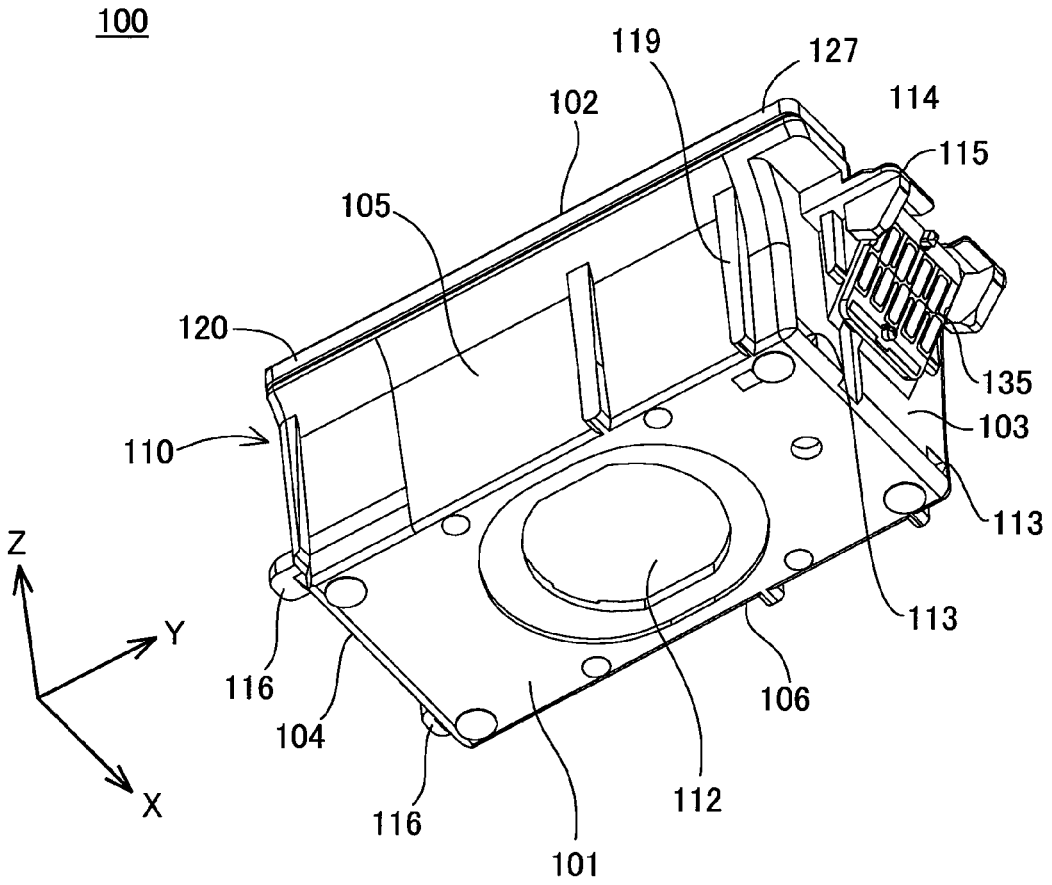
FIG. 3 is an upward perspective view illustrating the ink cartridge.
Figure 4:
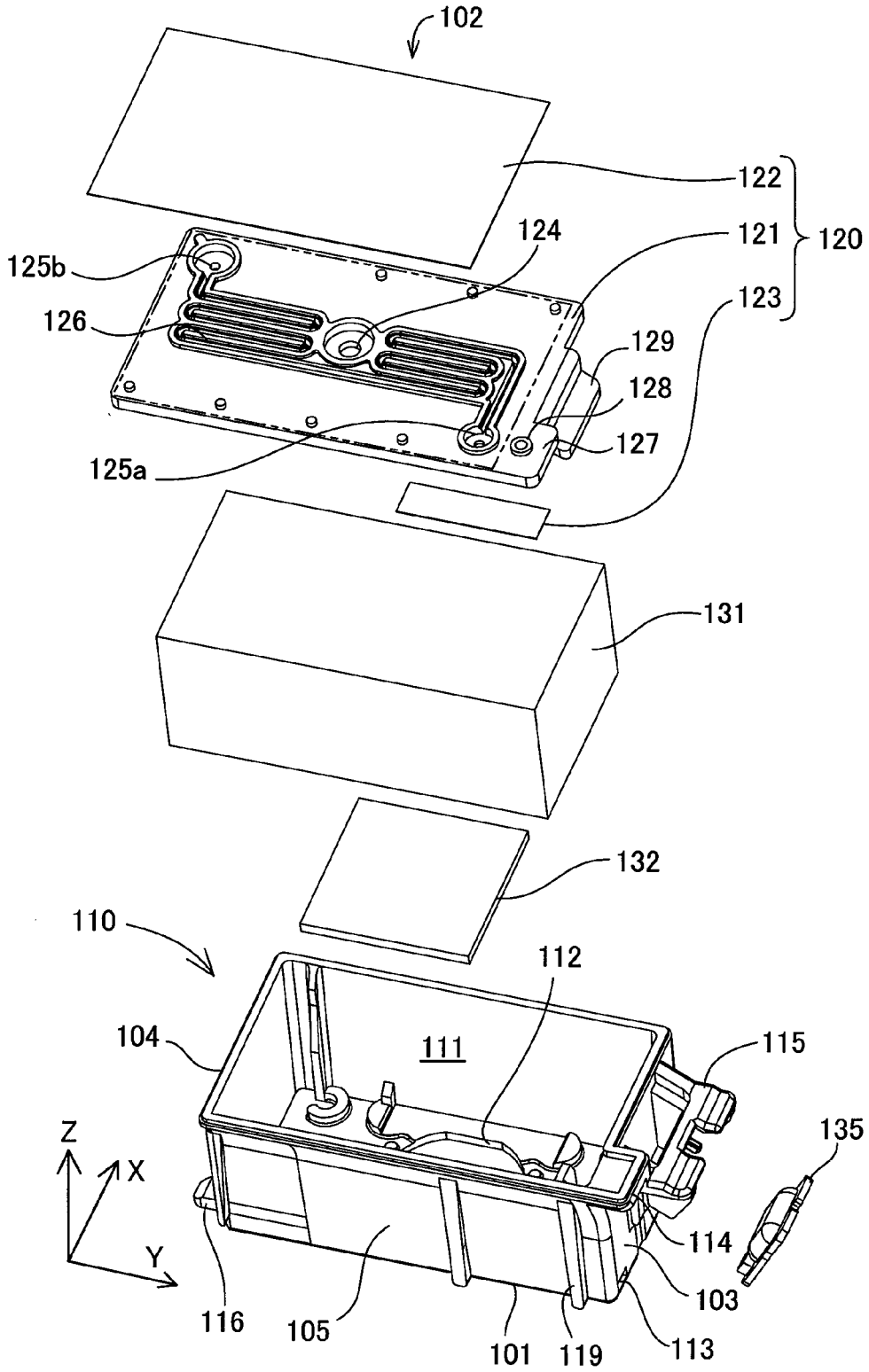
FIG. 4 is an exploded perspective view illustrating the ink cartridge.

The structure of the cartridge 100 is described with reference to FIGS. 2 to 4. FIG. 2 is a downward perspective view illustrating the cartridge 100. FIG. 3 is an upward perspective view illustrating the cartridge 100. FIG. 4 is an exploded perspective view illustrating the cartridge 100. FIGS. 2 to 4 include illustration of arrows X, Y and Z representing three directions orthogonal to one another, in order to clarify the correlation of the respective drawings.

The cartridge 100 is provided as a hollow container formed in an approximately rectangular parallelepiped shape and has six wall surfaces 101 to 106. The bottom surface 101 is a surface that faces the carriage when the cartridge 100 is mounted on the printer. The top surface 102 is a surface that is opposed to the bottom surface 101. The front surface 103 is a surface that is adjacent to the bottom surface 101 and the top surface 102 and faces the user when the cartridge 100 is mounted on the printer.

The rear surface 104 is a surface that is adjacent to the bottom surface 101 and the top surface 102 and is opposed to the front surface 103. The left side surface 105 is a surface that is adjacent to the bottom surface 101, the top surface 102, the front surface 103 and the rear surface 104 and is located on the left side of the front surface 103 in an orientation facing the front surface 103 with the bottom surface 101 on the lower side and the top surface 102 as the upper side.

The right side surface 106 is a surface that is adjacent to the bottom surface 101 and the top surface 102 and is opposed to the left side surface 105 across the front surface 103. The bottom surface 101 corresponds to the first wall surface; the top surface 102 corresponds to the second wall surface; the left side surface 105 corresponds to the third wall surface; and the front surface 103 corresponds to the fourth wall surface.

According to this embodiment, the configuration that the front surface 103 is adjacent to the bottom surface 101 may be translated as the configuration that the front surface 103 intersects with the bottom surface 101. The front surface 103 and the bottom surface 101 may not be necessarily in contact with each other, but there may be another surface placed between the front surface 103 and the bottom surface 101.

The arrow X represents a left-right direction (width direction) in which the left side surface 105 and the right side surface 106 of the cartridge 100 are opposed to each other and indicates a direction from the left side surface 105 toward the right side surface 106. The direction of the arrow X is parallel to the moving direction of the carriage (so-called main-scanning direction) when the cartridge 100 is mounted on the printer.

The arrow Y represents a direction parallel to a front-rear direction (depth direction) in which the front surface 103 and the rear surface 104 of the cartridge 100 are opposed to each other and indicates a direction from the front surface 103-side toward the rear surface 104-side of the cartridge 100. The direction of the arrow Y is parallel to the feeding direction of printing paper with respect to the carriage (so-called sub-scanning direction) when the cartridge 100 is mounted on the printer.

The arrow Z represents a top-bottom direction (height direction) in which the bottom surface 101 and the top surface 102 of the cartridge 100 are opposed to each other and indicates a direction from the bottom surface 101 toward the top surface 102 of the cartridge 100. In the description hereof, "left" or "right" denotes the direction on the basis of the direction of the arrow X, "front" or "rear" denotes the direction on the basis of the direction of the arrow Y, and "top" (or "upper") or "bottom (or "lower") denotes the direction on the basis of the direction of the arrow Z.

The cartridge 100 has a container main body 110 provided as a hollow box-shaped body which is made of a resin and has an upward opening, and a cover member 120 provided to cover the opening of the container main body 110 as shown in FIG. 4. The wall surfaces of the respective walls of the container main body 110 form the bottom surface 101, the front surface 103, the rear surface 104, the left side surface 105 and the right side surface 106 of the cartridge 100, and the upper surface of the cover member 120 forms the top surface 102.

A space defined by the container main body 110 and the cover member 120 forms an ink chamber 111 to contain ink therein. An ink supply port 112 is formed on the approximate center of the bottom surface 101 as a through hole communicating with the ink chamber 111. The ink supply port 112 corresponds to the liquid supply port. The printer receives a supply of ink from the cartridge 100 via the ink supply port 112.

A first ink retaining member 131 and a second ink retaining member 132 are placed in the ink chamber 111. The first and the second ink retaining members 131 and 132 are made of a porous resin material, for example, a foamed material such as polyurethane foam or a fibrous material of bundled polypropylene fibers. The first and the second ink retaining members 131 and 132 absorb and retain ink inside thereof.

The first ink retaining member 131 is formed in an approximately rectangular parallelepiped shape and has a volume close to the capacity of the ink chamber 111. The second ink retaining member 132 is formed in an approximately flat plate shape and is placed between the first ink retaining member 131 and the ink supply port 112 in the ink chamber 111. The second ink retaining member 132 is also called "wick".

The first and the second ink retaining members 131 and 132 have different characteristics of retaining the liquid. More specifically, the second ink retaining member 132 is made to have the higher pore density than the pore density of the first ink retaining member 131 and accordingly has the greater capillary force than the capillary force of the first ink retaining member 131. This makes the ink in the ink chamber 111 likely to be concentrated to the ink supply port 112.

The cover member 120 has a cover main body 121, a first seal member 122 and a second seal member 123. The cover main body 121 is formed from a plate-shaped resin member and has a center through hole 124 provided on the approximate center of the cover main body 121. The center through hole 124 is used as an ink injection hole in the manufacturing process of the cartridge 100. The center through hole 124 is sealed by the first seal member 122 at the time of factory shipment.

In the view of the cover main body 121 in a reverse direction of the arrow Z, a first through hole 125*a* is formed at a corner between the front surface 103 and the left side surface 105, and a second through hole 125*b* is formed at a corner between the rear surface 104 and the right side surface 106. The first and the second through holes 125*a* and 125*b* are connected with each other by a groove 126 formed on the upper surface of the cover main body 121. The groove 126 is folded a plurality of times in the direction of the arrow Y, so as to be arranged in an approximately serpentine shape. The first and the second through holes 125*a* and 125*b* and the groove 126 form an air flow path.

The first seal member 122 is formed from a resin film member in an approximately rectangular shape and is placed on the upper surface of the cover main body 121. The first seal member 122 is placed to cover and seal the respective openings of the center through hole 124, the first and the second through holes 125*a* and 125*b* and the groove 126 of the cover main body 121. The area of the cover main body 121 covered and sealed by the first seal member 122 is shown by the two-dot chain line in FIG. 4.

The cover main body 121 has a first extension 127 and a second extension 129 on its end intersecting with the front surface 103. The first extension 127 is extended straight forward from the area sealed by the first seal member 122 at a position adjacent to the left side surface 105. The first extension 127 has an air hole 128 formed as a through hole to take the air in. The air hole 128 is formed to be adjacent to the first through hole 125*a* in the direction of the arrow Y.

A groove (illustration is omitted) is formed on the lower surface of the cover main body 121 to connect the air hole 128 with the first through hole 125*a*. The second seal member 123 is formed from a resin film member in an approximately rectangular shape and is placed on the lower surface of the cover main body 121 to seal the openings of the air hole 128, the first through hole 125*a* and the groove connecting the air hole 128 and the first through hole 125*a* with each other.

In use of the cartridge 100 in the printer, the air hole 128 is kept in the open state to allow for introduction of the air on the top surface 102. When ink flows out through the ink supply port 112 of the cartridge 100, the air is introduced through the air hole 128 into the ink chamber 111. The air flows in from the air hole 128 to the first through hole 125*a*, flows through the groove 126 and is introduced via the second through hole 125*b* into the ink chamber 111. In the cartridge 100, forming the meandering air flow path ensures the sufficient flow path length from the ink chamber 111 to the outside of the cartridge 100 and thereby suppresses vaporization of ink from the ink chamber 111.

The second extension 129 of the cover main body 121 is extended in the direction of the arrow Y and falls in a step-shaped form. The second extension 129 is fit in a recess of a carriage engagement structure 115 formed on the container main body 110 and serves as part of the carriage engagement structure 115.

Two fitting holes 113, an extended part 114 and the carriage engagement structure 115 are provided on the front surface 103 of the container main body 110. The two fitting holes 113 are formed at the positions of both ends in the direction of the arrow X along a lower edge of the front surface 103. The respective fitting holes 113 serve as engagement elements to be engaged with fitting projections of the protection member 200 in the state of attachment of the protection member 200 (as described in detail later).

The extended part 114 is provided corresponding to the first extension 127 of the cover member 120. In the state that the cover member 120 is mounted to the container main body 110, the first extension 127 is supported upward by the extended part 114. The carriage engagement structure 115 is a part to be engaged with an engagement mechanism of the carriage for fixation of the cartridge 100 when the cartridge 100 is mounted to the carriage.

The carriage engagement structure 115 is formed as a flange-shaped structure extended forward at the approximately middle position in the direction of the arrow X. The carriage engagement structure 115 is provided on the front surface 103 that faces the user when the cartridge 100 is mounted to the printer. This makes the user accessible to the carriage engagement structure 115 in the state that the cartridge 100 is mounted to the printer and improves the operability in operation of mounting the cartridge 100.

A circuit substrate 135 is placed in a downwardly inclined orientation below the carriage engagement structure 115. The circuit substrate 135 is electrically connected with terminals on the printer in the state that the cartridge 100 is mounted to the carriage of the printer. When the cartridge 100 is mounted to the printer, the printer receives, from the circuit substrate 135, an electric signal indicating the mounting state of the cartridge 100 and information regarding the ink contained in the cartridge 100, for example, the color and the remaining amount of ink.

Two projections 116 are provided on the rear surface 104 of the container main body 110. The two projections 116 are formed to be protruded rearward at the positions of both ends in the direction of the arrow X along a lower edge of the rear surface 104. The respective projections 116 serve as engagement elements with respect to the protection member 200 when the protection member 200 is attached to the cartridge 100 as described in detail later. The respective projections 116 also serve as engagement elements with respect to the carriage when the cartridge 100 is mounted to the carriage of the printer. Detailed description about the mechanism of engagement by respective projections 116 is omitted.

The left side surface 105 and the right side surface 106 of the container main body 110 respectively have sloped surfaces that are slightly inclined downward. More specifically, the walls of the container main body 110 forming the left side surface 105 and the right side surface 106 are inclined such as to press the lower region of the first ink retaining member 131 more strongly by the walls of the container main body 110 and thereby enhance the capillary force. A plurality of ribs 119 in columnar shape stretched in the height direction are formed on the left side surface 105 and the right side surface 106. The ribs 119 serve as reinforcing elements of the cartridge 100 and also serve as engagement elements when the cartridge 100 is mounted to the printer.

[Structure of Protection Member]

Figure 5:
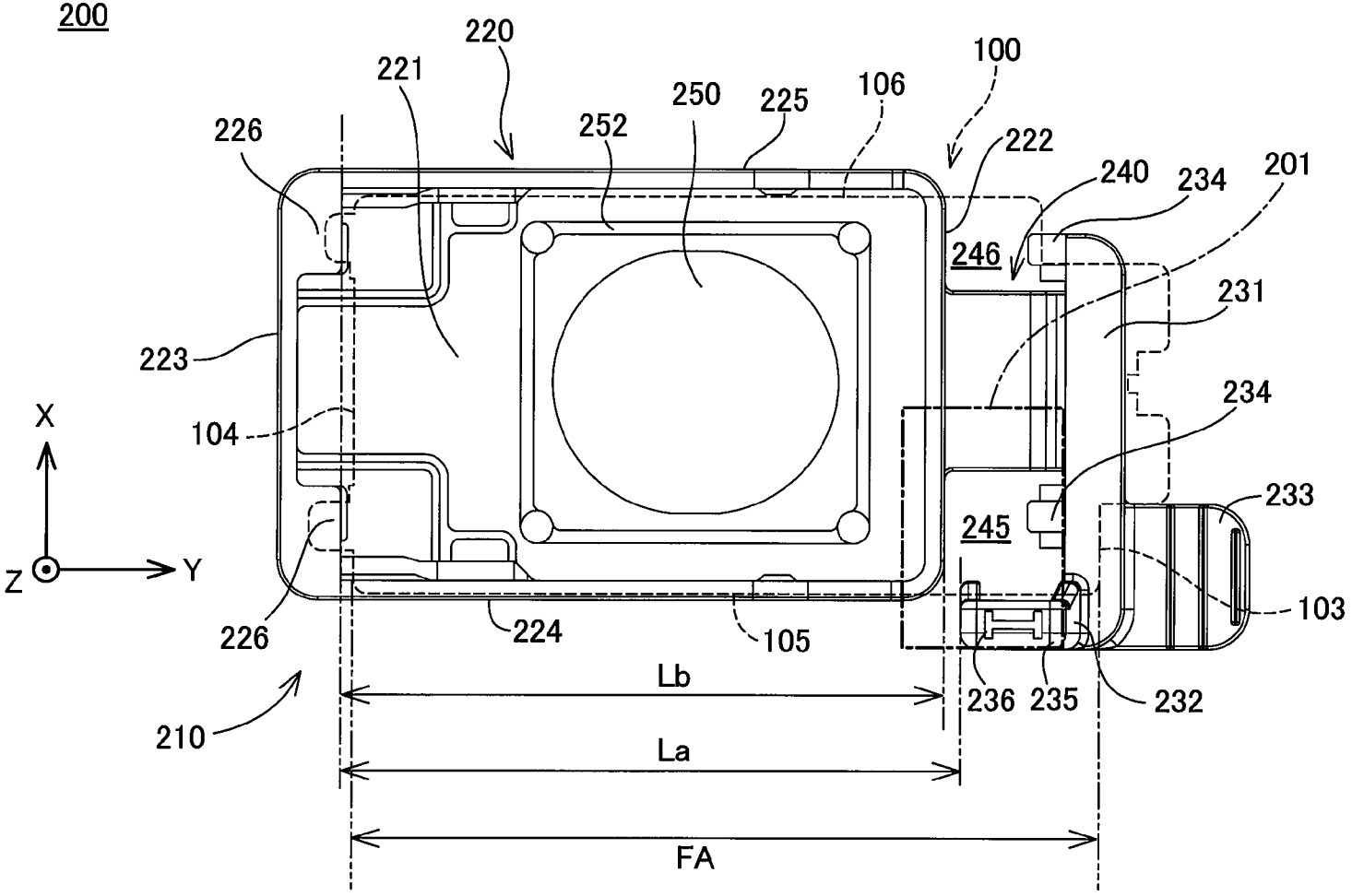
FIG. 5 is a schematic top view illustrating the protection member.
Figure 6:
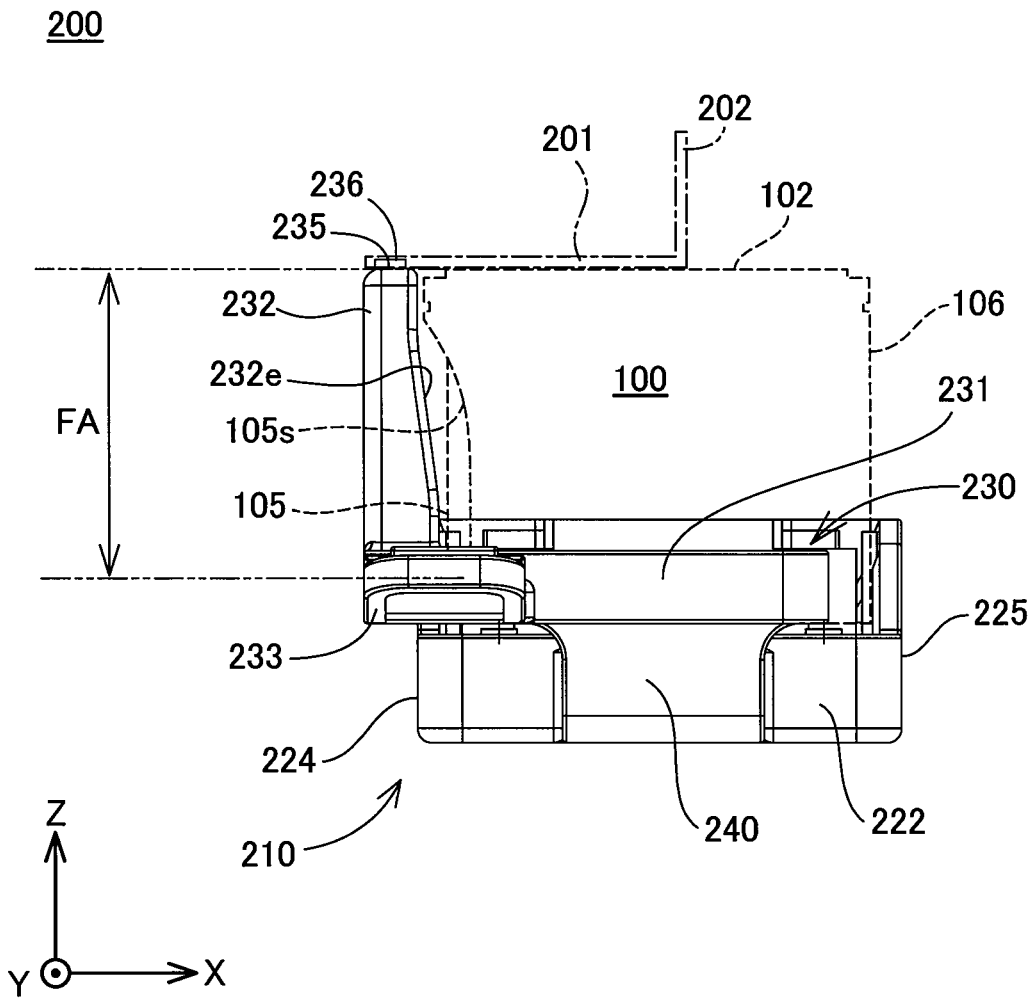
FIG. 6 is a schematic front view illustrating the protection member.
Figure 7:
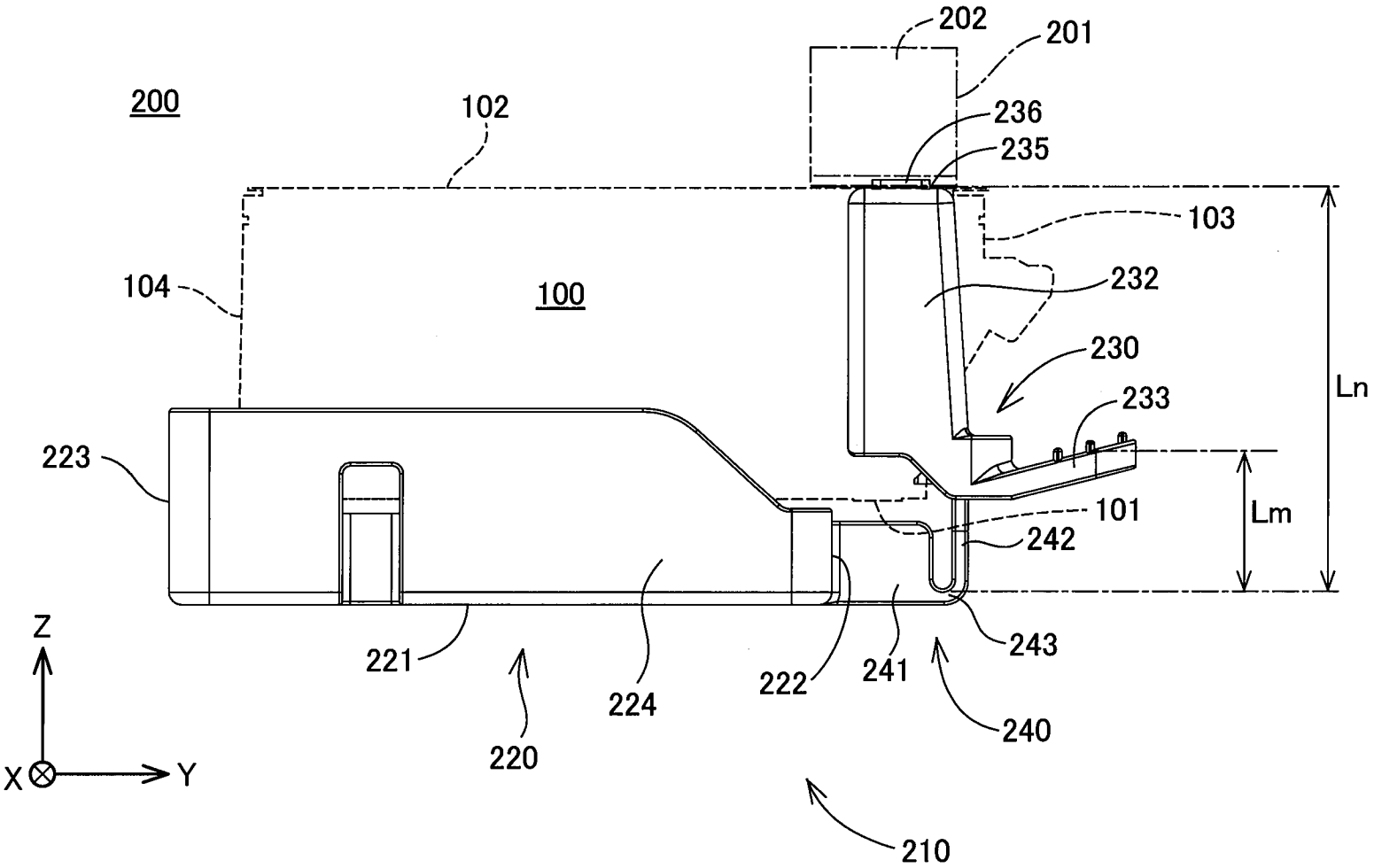
FIG. 7 is a schematic left side view illustrating the protection member.
Figure 8:
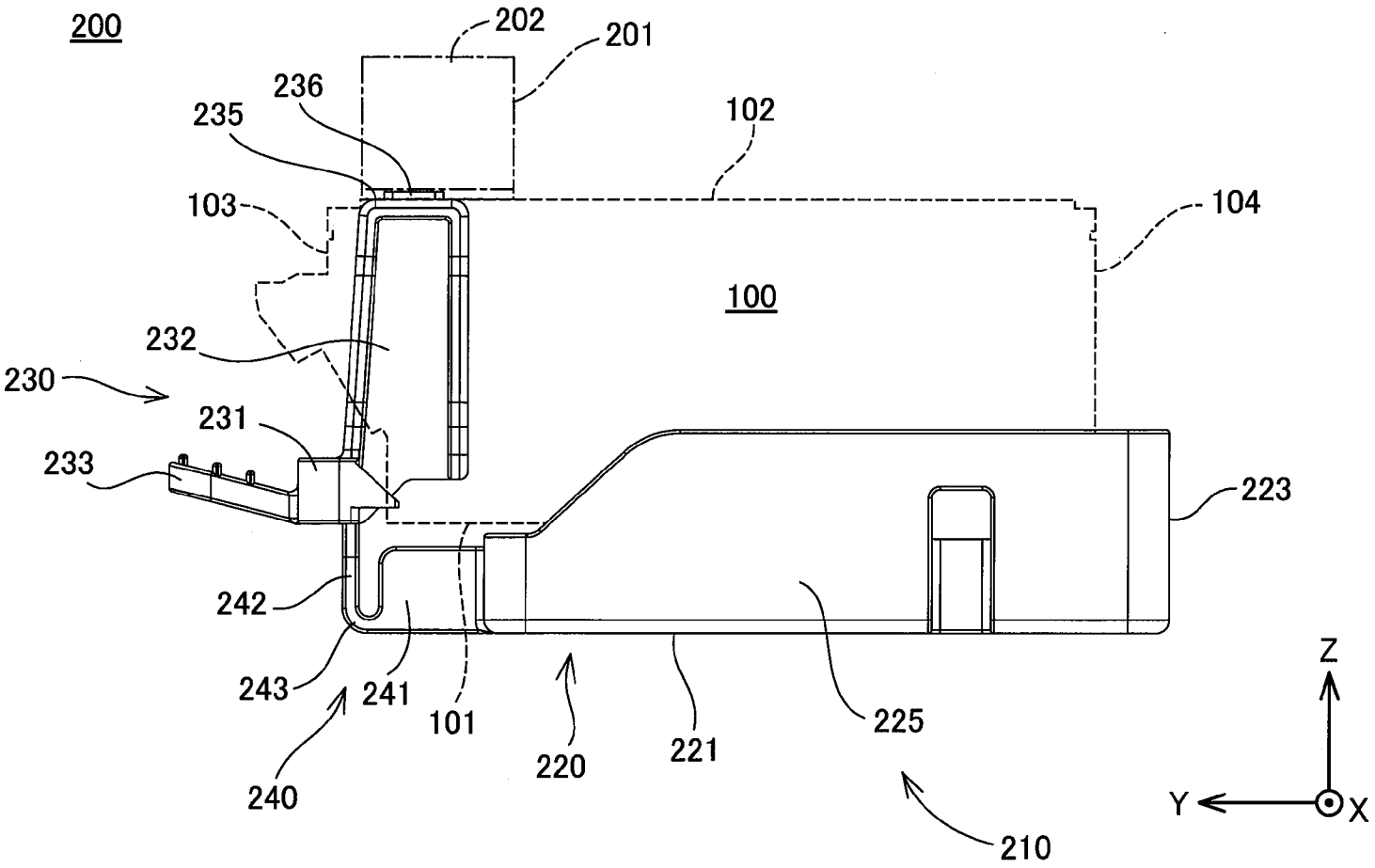
FIG. 8 is a schematic right side view illustrating the protection member.
Figure 9:
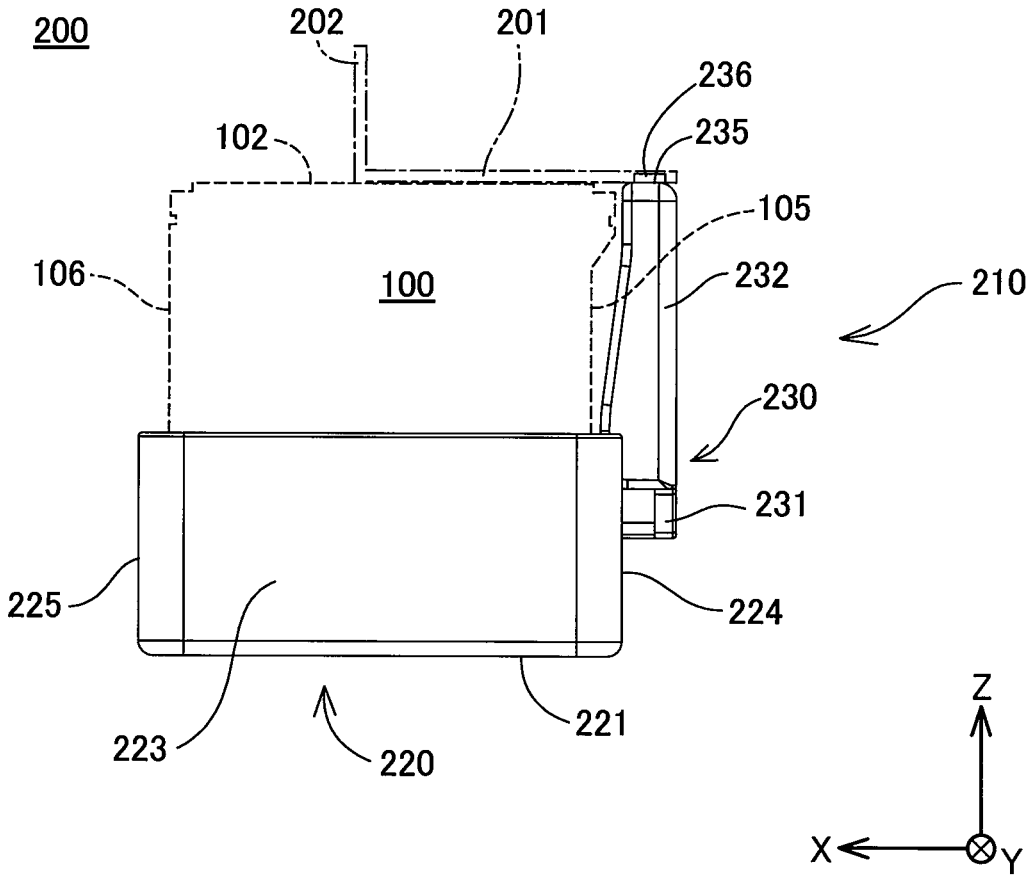
FIG. 9 is a schematic rear view illustrating the protection member.
Figure 10:
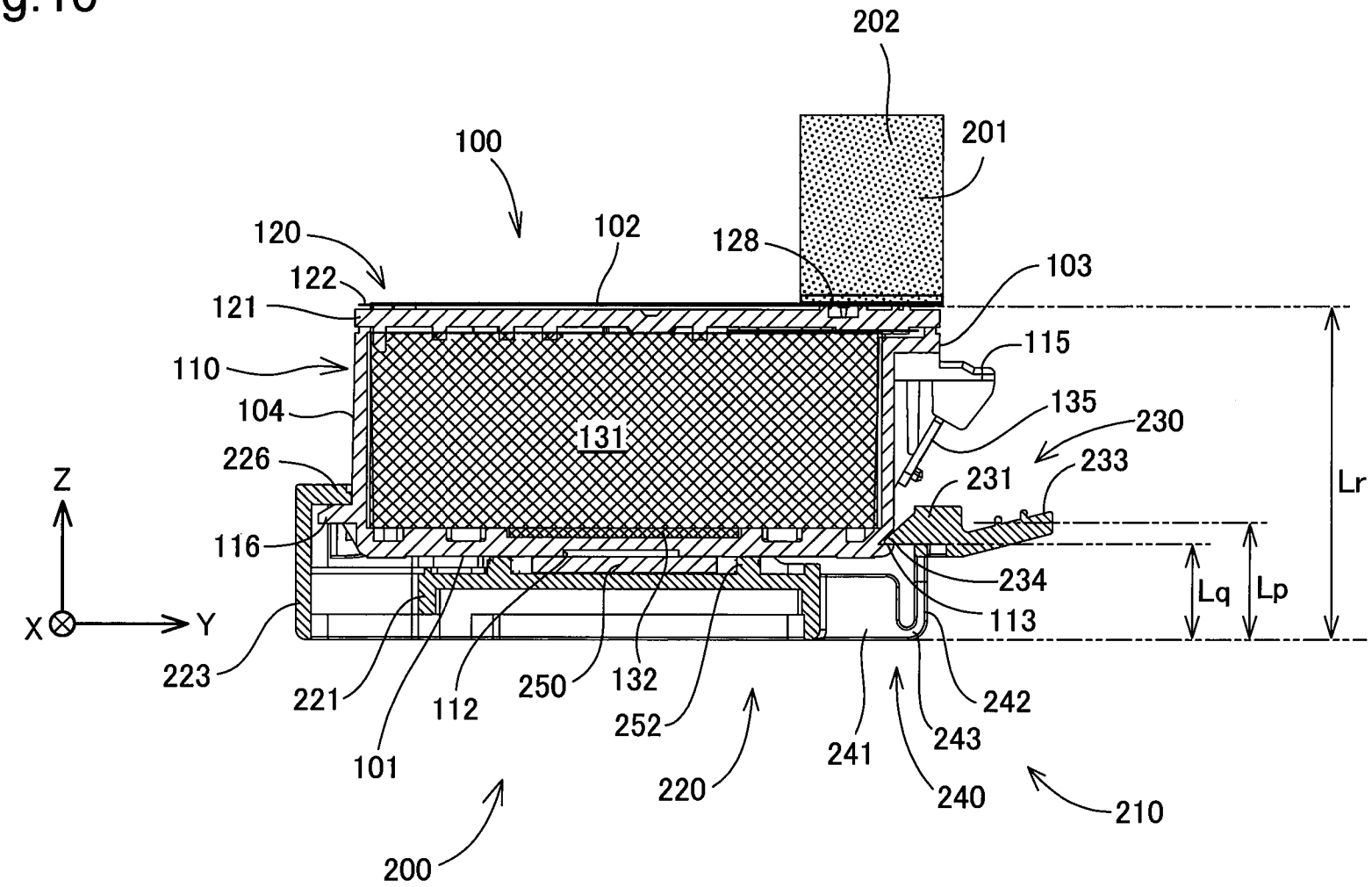
FIG. 10 is a schematic cross sectional view illustrating the ink cartridge and the protection member.

The detailed structure of the protection member 200 is described with reference to FIGS. 5 to 10. FIG. 5 is a schematic top view illustrating the protection member 200 viewed from the top side. FIG. 6 is a schematic front view illustrating the protection member 200 viewed from the front side. FIG. 7 is a schematic left side view illustrating the protection member 200 viewed from the left side. FIG. 8 is a schematic right side view illustrating the protection member 200 viewed from the right side. FIG. 9 is a schematic rear view illustrating the protection member 200 viewed from the rear side. FIG. 10 is a schematic cross sectional view illustrating the cartridge 100 and the protection member 200, taken on a line A-A in FIG. 1. FIGS. 5 to 10 include illustration of arrows X, Y and Z on the basis of the cartridge 100 with the protection member 200 attached thereto. As a matter of convenience, the film member 201 as shown in FIG. 1 is shown by the one-dot chain line in FIGS. 5 to 9. The contour of the outer circumference of the cartridge 100 with the protection member 200 attached thereto is shown by the broken line.

The holder structure 210 of the protection member 200 includes a cap section 220, a front end wall section 230 and a connecting section 240. The cap section 220 is a part mounted to face the bottom surface 101 of the cartridge 100 and protect the bottom surface 101. The front end wall section 230 is located on the front side of the cap section 220 and is connected with the cap section 220 by the connecting section 240. The front end wall section 230 corresponds to the first end wall. The holder structure 210 of this embodiment is produced by integrally molding the cap section 220, the front end wall section 230 and the connecting section 240.

The cap section 220 includes a bottom wall portion 221, a front wall portion 222, a rear wall portion 223, a left side wall portion 224 and a right side wall portion 225. The bottom wall portion 221 is a wall portion opposed to the bottom surface 101 of the cartridge 100 and corresponds to the sealing wall section. A seal member 250 is located on the bottom wall portion 221 as shown in FIG. 5. The seal member 250 corresponds to the sealing element provided to seal the ink supply port 112 formed in the bottom surface 101 of the cartridge 100. The seal member 250 is formed in a flat disk shape to cover the entire ink supply port 112. The seal member 250 may be made of an elastomeric rubber resin, such as elastomer.

The bottom wall portion 221 has a convexed wall element 252 formed to surround the seal member 250. The convexed wall element 252 has a fixed height from the bottom wall portion 221 in the direction of the arrow Z, which is smaller than the thickness of the seal member 250 in the direction of the arrow Z as shown in FIG. 10. The seal member 250 is located on the center of the area surrounded by the convexed wall element 252. When the protection member 200 is attached to the cartridge 100, the bottom surface 101 of the cartridge 100 is supported to be parallel to the surface of the seal member 250 by the convexed wall element 252. This configuration equalizes the pressing force of the seal member 250 against the bottom surface 101.

The front wall portion 222, the rear wall portion 223, the left side wall portion 224 and the right side wall portion 225 are wall portions arranged to surround the outer circumference of the bottom wall portion 221 and to be extended above the upper surface of the bottom wall portion 221. The respective wall portions 222 to 225 have areas intersecting with the bottom wall portion 221. The front wall portion 222 is located on the front side of the bottom wall portion 221 and is located below the bottom surface 101 when the protection member 200 is attached to the cartridge 100.

The rear wall portion 223 corresponds to the second end wall and is located on the rear side of the bottom wall portion 221. When the protection member 200 is attached to the cartridge 100, the rear wall portion 223 is located on the rear side of the rear surface 104 of the cartridge 100 and comes into contact with the rear surface 104 to support the cartridge 100. The rear wall portion 223 has an extension 226 extended horizontally toward the area where the cartridge 100 is placed. When the protection member 200 is attached to the cartridge 100, the extension 226 is engaged downward with the two projections 116 provided along the lower edge of the rear surface 104 of the cartridge 100 as shown in FIG. 10. In the description herein, the expression "engaging" means the expression "engaging with a specified part of an object to limit the moving direction of the object".

The left side wall portion 224 and the right side wall portion 225 of the cap section 220 respectively correspond to the first side wall and the second side wall and are located on the left side and on the right side of the bottom wall portion 221 when the protection member 200 is viewed from the front side as shown in FIGS. 5 and 6. When the protection member 200 is attached to the cartridge 100, the left side wall portion 224 and the right side wall portion 225 come into contact with the left side surface 105 and the right side surface 106 of the cartridge 100 to support the cartridge 100 placed therebetween.

The front end wall section 230 includes an extended portion 231, a columnar support portion 232 and an operating portion 233. The extended portion 231 is extended in the direction of the arrow X and is arranged parallel to the front wall portion 222 of the cap section 220. In the state that the protection member 200 is attached to the cartridge 100, the extended portion 231 is located on the lower side of the carriage engagement structure 114 and comes into contact with the lower edge of the front surface 103 of the cartridge 100 to support the cartridge 100.

The extended portion 231 has two fitting projections 234 protruded toward the area where the cartridge 100 is placed. In the state that the protection member 200 is attached to the cartridge 100, the two fitting projections 234 are fit in the two fitting holes 113 formed in the front surface 103 of the cartridge 100 and serve as engaged elements to retain the cartridge 100. In the description herein, the term "retaining" means engaging with and thereby retaining an object.

The columnar support portion 232 corresponds to the supporting structure and is located in an area FA opposed to the left side surface 105 of the cartridge 100 in the state that the protection member 200 is attached to the cartridge 100 as shown in FIGS. 5 and 6. The columnar support portion 232 is extended along the left side surface 105 from a position near to the bottom surface 101 of the cartridge 100 to a position of substantially the same height as the height of the top surface 102. The columnar support portion 232 has its lower end connected with an end of the extended portion 231.

The film member 201 is welded to an upper end surface 235 of the columnar support portion 232. The upper end surface 235 of the columnar support portion 232 corresponds to the joint part. The upper end surface 235 of the columnar support portion 232 and the film member 201 are joined with each other to have a higher joining force than at least the welding force of the film member 201 to the cartridge 100. A projection 236 protruded upward is provided on the center of the upper end surface 235. The projection 236 is fit in a through hole provided in the film member 201. This enhances the fixation of the film member 201 to the columnar support portion 232.

The film member 201 is formed from a tape-shaped resin film member in an approximately rectangular shape. The film member 201 is disposed between the columnar support portion 232 and the cartridge 100 in the state that the protection member 200 is attached to the cartridge 100. According to this embodiment, the film member 201 is arranged to be extended in a substantially horizontal orientation with no slack in the direction of the arrow X from the upper end surface 235 of the columnar support portion 232 toward the top surface 102 of the cartridge 100.

The film member 201 has a welding surface which is welded and fixed to the top surface 102 of the cartridge 100 and is arranged to cover and seal the air hole 128 provided on the top surface 102. Welding the film member 201 to the top surface 102 of the cartridge 100 fixes the position of the columnar support portion 232 with respect to the cartridge 100 and limits the motion of the columnar support portion 232. A cartridge 100-side end 202 of the film member 201 does not have a welding surface and is not welded to the top surface 102 of the cartridge 100. This enables the user to pull the end 202 of the film member 201 and separate the film member 201 from the top surface 102 of the cartridge 100.

The operating portion 233, as shown in FIGS. 5 to 8, is a part held by the user's finger to detach the protection member 200 from the cartridge 100. The operating portion 233 is provided as a tongue-shaped plate member extended forward from the extended portion 231. In the protection member 200 of the embodiment, when the protection member 200 is viewed in the reverse direction of the arrow Y, the operating portion 233 is formed at a position aligned with a lower edge of the columnar support portion 232 as shown in FIG. 6. The operation of detaching the protection member 200 from the cartridge 100 by using the operating portion 233 will be described later.

The connecting section 240 is provided on the substantial center in the direction of the arrow X on the front wall portion 222 of the cap section 220 to connect the front wall portion 222 with the extended portion 231 of the front end wall section 230. The connecting section 240 includes a thick wall portion 241 connected with the front wall portion 222, and a thin wall portion 242 connected with the extended portion 231 of the front end wall section 230 as shown in FIG. 8.

When the protection member 200 is viewed in the direction of the arrow X, the thick wall portion 241 is relatively thicker than the thin wall portion 242, and the thin wall portion 242 is relatively thinner than the thick wall portion 241. The "thick wall portion 241" and the "thin wall portion 242" are only designations for the sake of convenience and may have any thicknesses appropriately determined. According to a modification of this embodiment, the thick wall portion 241 and the thin wall portion 242 may be arranged to have identical thicknesses. According to another modification, the thick wall portion 241 may be arranged to be thinner than the thin wall portion 242.

The thick wall portion 241 is extended from the front wall portion 222 to the position where the front surface 103 of the cartridge 100 is located. The thin wall portion 242 is bent from a lower front edge of the thick wall portion 241 to be extended upward and join with the lower surface of the extended portion 231 of the front end wall section 230. A bent 243 of the thin wall portion 242 serves as a supporting point of rotation in rotational motion of the front end wall section 230 in a direction away from the cartridge 100 fixed to the cap section 220 in the course of detachment of the protection member 200 from the cartridge 100 as described in detail later.

The width of the connecting section 240 in the direction of the arrow X is smaller than the width of the extended portion 231 of the front end wall section 230 and the width of the front wall portion 222 of the cap section 220. Accordingly, when the protection member 200 is viewed in the reverse direction of the arrow Z, a first void space 245 corresponding to the first interval is formed between the front end wall section 230 and the front wall portion 222 and the left side wall portion 224 of the cap section 220. A second void space 246 corresponding to the second interval is formed between the front end wall section 230 and the front wall portion 222 and the right side wall portion 225 of the cap section 220. The presence of these void spaces 245 and 246 facilitates the rotational motion of the front end wall section 230.

[Detachment Method of Protection Member]

Figure 11:
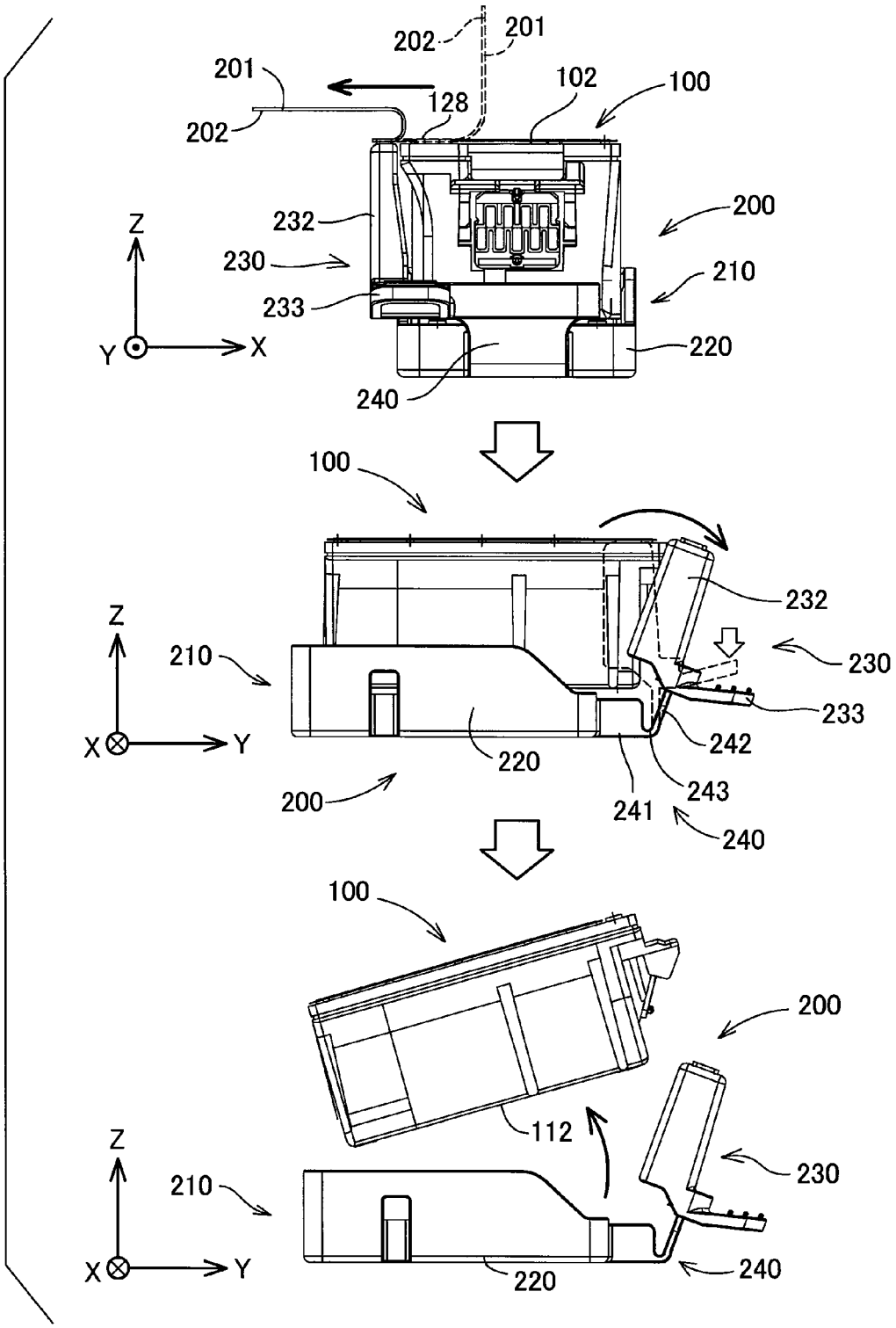
FIG. 11 is diagrams sequentially illustrating detachment steps of the protection member from the ink cartridge.

FIG. 11 is diagrams sequentially illustrating detachment steps of the protection member 200 from the cartridge 100. At a first step, the user pulls the end 202 of the film member 201 toward the columnar support portion 232, so as to separate the film member 201 from the top surface 102 of the cartridge 100. This releases the sealing of the air hole 128 and removes the fixation of the columnar support portion 232 to the cartridge 100.

At a second step, the user presses the operating portion 233 downward with the finger, so that the entire front end wall section 230 including the columnar support portion 232 is rotated and moved in a direction away from the cartridge 100 about the bent of the connecting section 240 as the supporting point. This separates the fitting projections 234 of the front end wall section 230 from the fitting holes 113 of the cartridge 100 and releases the engagement. At a third step, the cartridge 100 is detached from the cap section 220. This separates the ink supply port 112 of the cartridge 100 from the seal member 250 of the cap section 220 and releases the sealing of the ink supply port 112.

As described above, the protection member 200 of the embodiment is readily detachable from the cartridge 100. In the state that the protection member 200 of the embodiment is attached to the cartridge 100, welding the film member 201 limits the motion of the columnar support portion 232, so as to limit the detachment operation of the cap section 220 from the cartridge 100. Separating the film member 201 from the top surface 102 of the cartridge 100 removes the fixation of the columnar support portion 232 and allows for the detachment operation of the cap section 220 from the cartridge 100. This arrangement specifies the sequence of releasing the sealing of the air hole 128 and the sealing of the ink supply port 112 in the course of detachment of the protection member 200 from the cartridge 100. This configuration accordingly suppresses the sealing of the ink supply port 112 from being released prior to release of the sealing of the air hole 128 and thereby suppresses the air from entering the ink chamber 111 via the ink supply port 112 and being accumulated in the area near to the second ink retaining member 132.

[Details of Advantageous Effects Achieved by Protection Member]

(1) Advantageous Effects by Location of Columnar Support Portion

In the protection member 200 of the embodiment, the columnar support portion 232 is located along the left side surface 105 in the area FA shown in FIGS. 5 and 6 or more specifically in the area FA opposed to the left side surface 105 of the cartridge 100 in the state that the protection member 200 is attached to the cartridge 100. Accordingly, the left side surface 105 defines the movable direction of the columnar support portion 232. This suppresses the welding of the film member 201 to the cartridge 100 from being damaged by the incorrect motion of the columnar support portion 232. This configuration suppresses the user's improper operation of moving the columnar support portion 232 in a wrong direction in the course of detachment of the protection member 200.

According to this embodiment, the carriage engagement structure 115 is provided on the front surface 103 of the cartridge 100, and the circuit substrate 135 is located below the carriage engagement structure 115 as shown in FIGS. 2 to 4. The first extension 127 having the air hole 128 is protruded forward from the front surface 103 of the cartridge 100. A large number of concavities and convexities forming, for example, the mounting mechanism to the carriage are generally formed on the outer surface of the ink cartridge. It is accordingly desirable to configure the protection member which is to be attached to the ink cartridge, such as to enhance the protection of the ink cartridge by taking into account such concavities and convexities. In the protection member 200 of the embodiment, no component extended in the height direction of the cartridge 100 like the columnar support portion 232 is provided in the area opposed to the front surface 103 of the cartridge 100, so that there is no need to take into account the complicated concavo-convex structure of the front surface 103. This suppresses complication of the structure of the protection member 200. This also suppresses generation of a wasted space between the protection member 200 and the concavo-convex surface of the cartridge 100, thus enhancing the protection of the cartridge 100 by the protection member 200.

With referring to FIG. 5, in the plan view of the protection member 200 in the direction toward the wall surface of the bottom wall portion 221 (in the reverse direction of the arrow Z), La represents a distance in the direction of the arrow Y between the upper end surface 235 of the columnar support portion 232 and the rear wall portion 223 on the bottom wall portion 221. Lb represents a distance in the direction of the arrow Y between the connecting section 240 and the rear wall portion 223 on the bottom wall portion 221. The two distances La and Lb preferably satisfy the relation of La≥Lb. This configuration causes the upper end surface 235 as the joint part of the columnar support portion 232 and the film member 201 to be located near to the supporting point of rotational motion of the front end wall section 230, thus enhancing the fixation of the columnar support portion 232 by the film member 201. In the protection member 200 of this embodiment, the two distances La and Lb satisfy the relation of La>b. This configuration ensures the fixation of the columnar support portion 232 by the film member 201.

(2) Advantageous Effects by Shape of Columnar Support Portion

With referring to FIG. 6, according to this embodiment, the left side surface 105 of the cartridge 100 has a sloped area 105*s* slightly inclined downward with respect to the bottom surface 101 in order to enhance the flowability of ink to the ink supply port 112. In the protection member 200 of the embodiment, an end 232*e* of the columnar support portion 232 opposed to the left side surface 105 is inclined with respect to the bottom wall portion 221 in conformity with the sloped area 105*a* of the left side surface 105 of the cartridge 100. This configuration suppresses generation of a wasted space between the cartridge 100 and the columnar support portion 232, thus enhancing the protection of the cartridge 100 by the protection member 200.

(3) Advantageous Effects by Height of Columnar Support Portion

In the state that the protection member 200 of the embodiment is attached to the cartridge 100, the height position of the upper end surface 235 of the columnar support portion 232 from the bottom wall portion 221 is equal to the height position of the air hole 128 on the top surface 102 of the cartridge 100 from the bottom wall portion 221 as shown in FIGS. 6 to 9. This configuration suppresses a potential twist or deflection of the film member 201 and makes the film member 201 likely to ensure the sealing property of the air hole 128. This configuration also makes the film member 201 likely to ensure the fixation of the protection member 200 to the cartridge 100.

The height position of the upper end surface 235 of the columnar support portion 232 from the bottom wall portion 221 may be higher than the position of the top surface 102 of the cartridge 100. In this configuration, however, when an external force is applied to the columnar support portion 232 to shift the position of the upper end surface 235, a force may be applied to the film member 201 in a direction of separating from the top surface 102. The height position of the upper end surface 235 of the columnar support portion 232 from the bottom wall portion 221 may be lower than the position of the top surface 102 of the cartridge 100. This configuration is, however, like to deteriorate the positional fixation of the columnar support portion 232 by the film member 201. Accordingly, it is desirable that the height position of the upper end surface 235 of the columnar support portion 232 is equal to the height position of the air hole 128 on the top surface 102 of the cartridge 100. The state of "equal" herein means the substantially equal state, i.e., the state with no significant difference between the height position of the upper end surface 235 of the columnar support portion 232 and the top surface 102 of the cartridge 100. The state "with no significant difference" includes the state with a difference between the height position of the upper end surface 235 of the columnar support portion 232 and the top surface 102 of the cartridge 100 such that the film member 201 joined with the projections 236 and the air hole 128 without deflection is not readily separated by a small external force but is maintained in the joined state. The "small external force" may be, for example, an external force applied to the film member 201 when the user unintentionally touches the film member 201.

Figure 12:
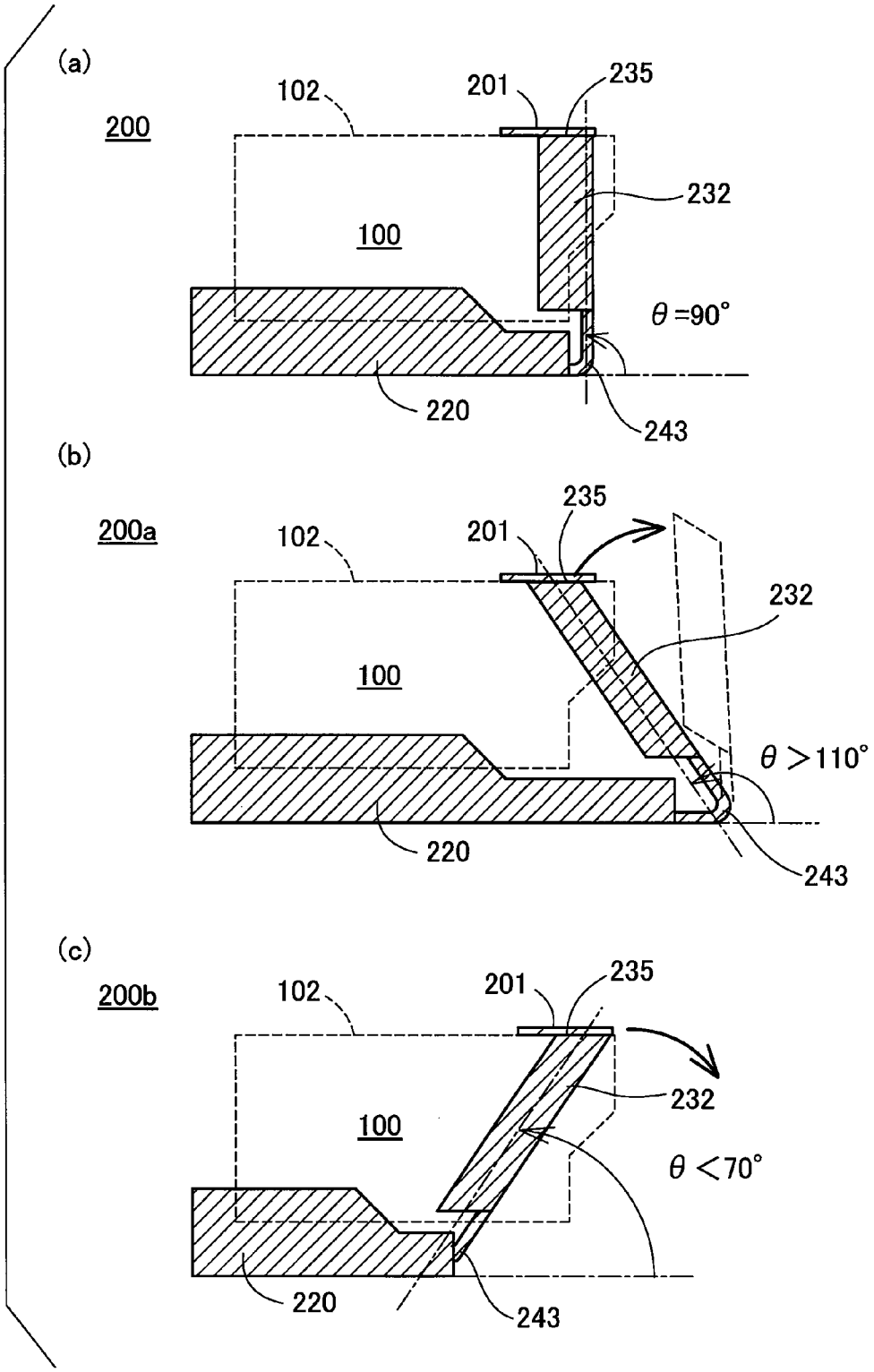
FIG. 12 is a diagram illustrating a preferable position of an upper end surface with respect to the position of a supporting point of rotational motion of a columnar support portion.

(4) Advantageous Effects by Positional Relation Between Columnar Support Portion and Upper End Surface FIG. 12 is a diagram illustrating a preferable position of the upper end surface 235 with respect to the position of the supporting point of rotational motion of the columnar support portion 232. The section (a) of FIG. 12 illustrates the protection member 200 according to this embodiment. The sections (b) and (c) illustrate protection members 200*a* and 200*b* as modifications of the protection member 200 of the embodiment. The protection members 200*a* and 200*b* of the modifications have substantially the similar structures to that of the protection member 200 of the embodiment, except different angles θ as described below.

In the plan view in the direction of the arrow X, θ represents an angle of a virtual line of connecting the bent 243 of the connecting section 240 serving as the supporting point of rotational motion of the columnar support portion 232 with the upper end surface 235 of the columnar support portion 232 by the shortest distance with respect to the wall surface of the bottom wall portion 221. The angle θ corresponds to the angle of the direction from the bent 243 of the connecting section 240 toward the upper end surface 235 of the columnar support portion 232 with respect to the wall surface of the bottom wall portion 221. The angle θ may also be translated as the angle of the extending direction of the columnar support portion 232 with respect to the wall surface of the bottom wall portion 221. In the description below, the angle θ has a positive value in the counterclockwise direction with respect to the wall surface of the bottom wall element 221 as 0 degree.

In the protection member 200 of the embodiment, the angle θ is substantially equal to 90 degrees as shown in the section (a). In the protection member 200*a* of the modification, on the other hand, the angle θ is larger than 110 degrees as shown in the section (b). In the protection member 200*b* of the modification, the angle θ is smaller than 70 degrees as shown in the section (c).

In the protection member 200 of the embodiment, when an external force is applied in the direction of rotational motion of the columnar support portion 232 in the state that the columnar support portion 232 is fixed by the film member 201, a force in the direction of the arrow Y is mainly generated between the film member 201 and the upper end surface 235 of the columnar support portion 232. This force is cancelled by the joining force and the frictional force between the film member 201 and the upper end surface 235 and the tension of the film member 201. In the protection member 200 of the embodiment, in the above case, it is unlikely to generate a force in the direction of causing deformation such as twist of the film member 201 or a force in the direction of separating the film member 201 from the cartridge 100 or the columnar support portion 232. As described, the protection member 200 of the embodiment ensures the restraining force in motion of the columnar support portion 232 by the film member 201.

In the protection member 200*a* of the modification as shown in the section (b), the upper end surface 235 is moved to above the top surface 102 of the cartridge 100 by the rotational motion of the columnar support portion 232 in the illustrated direction of arrow. For example, when an external force in the direction of the arrow Y is unintentionally applied to the columnar support portion 232, the film member 201 is likely to be lifted up and separated from the top surface 102 of the cartridge 100 and thereby allow for rotational motion of the columnar support portion 232. The angle θ of not larger than 110 degrees, however, reduces such likelihood.

In the protection member 200*b* of the modification as shown in the section (c), the columnar support portion 232 is inclined in the specified direction of rotational motion and is thus more likely to be rotated and moved in the illustrated direction of arrow. The rotational motion of the columnar support portion 232 in the illustrated direction moves the upper end surface 235 downward to generate a force in the direction of separating the upper end surface 235 from the film member 201. As descried, the protection member 200*b* of this modification is also likely to reduce the restraining force in motion of the columnar support portion 232 by the film member 201, compared with the protection member 200 of the embodiment. The angle θ of not smaller than 70 degrees, however, reduces such likelihood.

Like the protection members 200*a* and 200*b* of the above modifications, the angle θ may be larger than 110 degrees or may be smaller than 70 degrees. The angle θ closer to 90 degrees, however, enhances the restraining force in rotational motion of the columnar support portion 232 by the film member 201. Accordingly the angle θ is preferably not smaller than 70 degrees and not larger than 110 degrees (70 degrees≤θ≤110 degrees) and is more preferably not smaller than 80 degrees and not larger than 100 degrees (80 degrees≤θ≤100 degrees).

(5) Advantageous Effects by Location of Operating Portion

Referring to FIG. 6, when the protection member 200 of the embodiment is viewed in the reverse direction of the arrow Y, the operating portion 233 is provided at the position offset to the columnar support portion 232-side, i.e., at the position nearer to the left side wall portion 224 than the right side wall portion 225. This configuration enhances the fixation of the operating portion 233 associated with restriction in motion of the columnar support portion 232 by the film member 201. The user is thus more likely to be aware of the requirement that the film member 201 should be removed prior to the operation of the operating portion 233. This accordingly suppresses the improper operation in the course of detachment of the protection member 200 from the cartridge 100.

Referring to FIG. 7, in the protection member 200 of the embodiment, in the direction of the arrow Z, a distance Ln from the bent 243 of the connecting section 240 to the upper end surface 235 of the columnar support portion 232 is longer than a distance Lm from the bent 243 of the connecting section 240 to the operating portion 233. In other words, in the protection member 200 of the embodiment, the power point which an external force is applied to via the operating portion 233 is close to the supporting point of the rotational motion of the columnar support portion 232. Accordingly there is a need to apply a certain magnitude of force to the operating portion 233 for rotation of the columnar support portion 232. This configuration suppresses an external force from being unintentionally applied to the operating portion 233 and removing the fixation of the columnar support portion 232 by the film member 201.

Referring to FIG. 10, in the protection member 200 of the embodiment, in the direction of the arrow Z in which the protection member 200 is attached to the cartridge 100, a distance Lp from the bottom wall portion 221 to the operating portion 233 is larger than a distance Lq from the bottom wall portion 221 to the fitting projections 234. The distance Lp is smaller than a distance Lr from the bottom wall portion 221 to the upper end surface 235 of the columnar support portion 232. The restraining force in rotational motion of the front end wall section 230 by the film member 201 is accordingly greater than the force required to release the engagement of the fitting projections 234 by the rotational motion of the front end wall section 230. This configuration suppresses the sealing of the ink supply port 112 from being released prior to release of the sealing of the air hole 128.

CONCLUSION

As described above, the protection member 200 of the embodiment is configured to facilitate the operation of detachment from the cartridge 100. The sequence of releasing the sealing of the air hole 128 and the sealing of the ink supply port 112 in the course of detachment from the cartridge 100 is specified by the simple configuration. Additionally, the protection member 200 of the embodiment has various functions and advantageous effects achieved by the simple configuration, such as the enhanced fixation and the protection of the cartridge 100 by the protection member 200.

B. Second Embodiment

Figure 13:
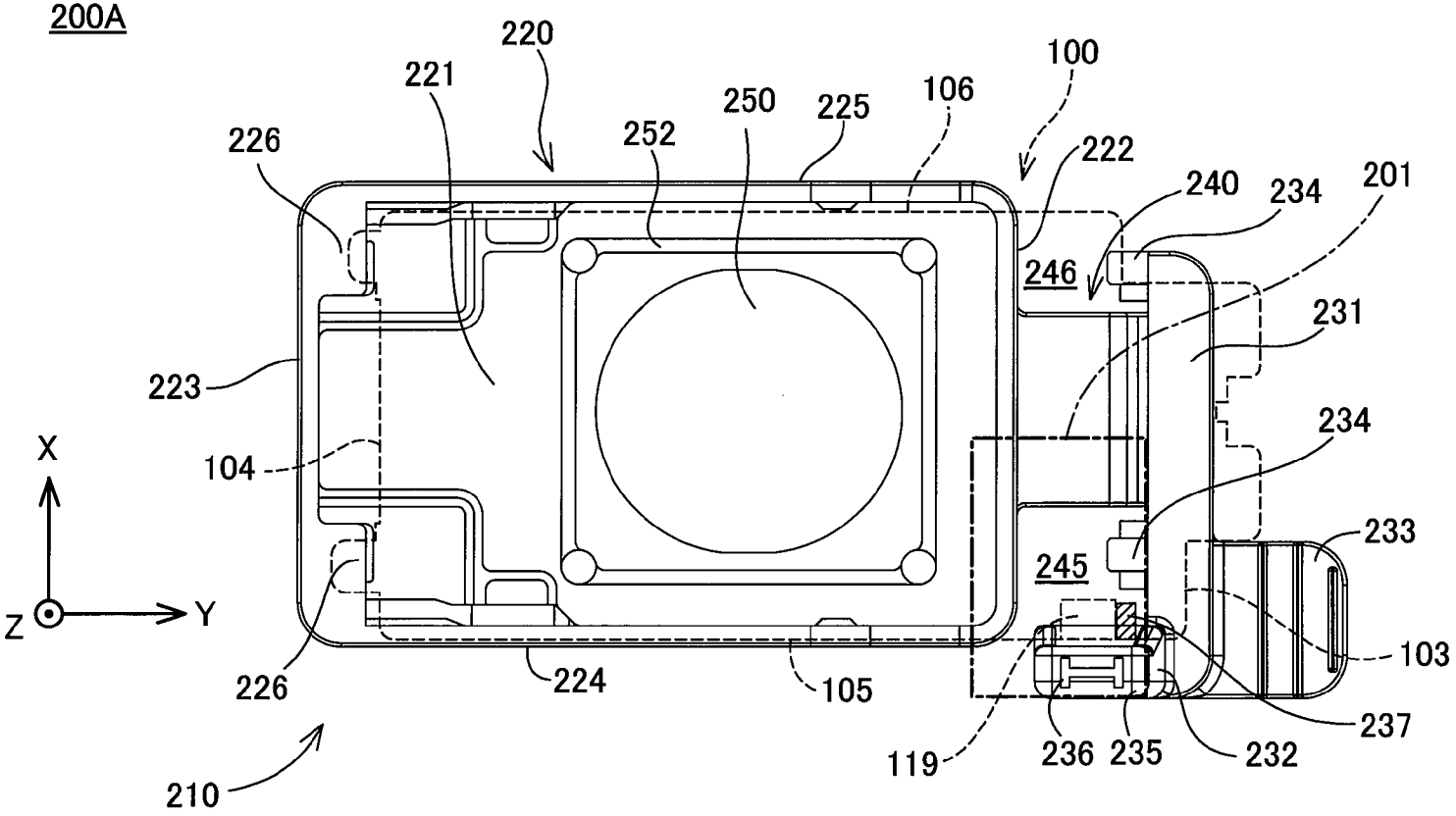
FIG. 13 is a schematic top view illustrating a protection member according to a second embodiment.
Figure 14:
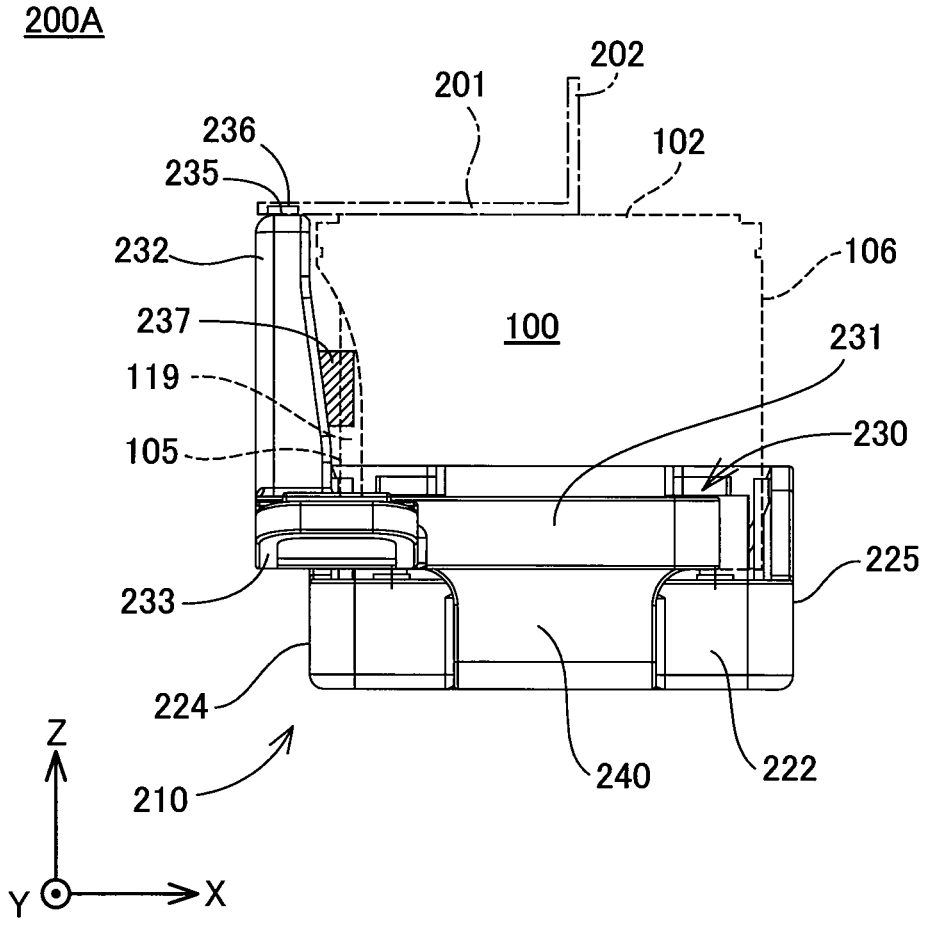
FIG. 14 is a schematic front view illustrating the protection member of the second embodiment.

The following describes the structure of a protection member 200A according to a second embodiment of the invention with reference to FIGS. 13 and 14. FIG. 13 is a schematic top view illustrating the protection member 200A of the second embodiment. FIG. 14 is a schematic front view illustrating the protection member 200A of the second embodiment. The contour of the outer circumference of the cartridge 100 with the protection member 200A attached thereto is shown by the broken line in FIGS. 13 and 14.

The protection member 200A of the second embodiment is attached to the cartridge 100 described in the first embodiment as shown in FIGS. 2 to 4. The protection member 200A of the second embodiment has substantially the same structure as that of the protection member 200 of the first embodiment, except that a motion-restraining projection 237 is provided on the columnar support portion 232. The motion-restraining projection 237 is formed to be protruded toward the cartridge 100 at the middle position in the height direction of the columnar support portion 232 (direction of the arrow Z).

The motion-restraining projection 237 is located at the position adjacent to the rib 119 on the left side surface 105 of the cartridge 100 such as to be engaged with the rib 119 in the state that the protection member 200A is attached to the cartridge 100. Engagement of the motion-restraining projection 237 with the rib 119 restrains the rotational motion of the columnar support portion 232 in the reverse direction of the arrow Y.

In the protection member 200A of the second embodiment, the motion-restraining projection 237 suppresses the rotational motion of the columnar support portion 232 in the reverse direction of the arrow Y in the state that the protection member 200A is attached to the cartridge 100. This configuration suppresses an external force from being unintentionally applied to the columnar support portion 232 to rotate and move the columnar support portion 232 and remove the film member 201. Accordingly this enhances the protection of the cartridge 100 by the protection member 200A.

For example, at the time of factory shipment, the cartridge 100 with the protection member 200A attached thereto may be wrapped by a wrapping material made of an air-tight flexible film to be sealed under reduced pressure. Even in this case, in the protection member 200A of the second embodiment, the motion-restraining projection 237 suppresses the columnar support portion 232 from being pressed by the wrapping material under the reduced pressure to be unintentionally rotated and moved. Accordingly this keeps the cartridge 100 in the sealed state at the factory shipment.

As described above, in the protection member 200A of the second embodiment, the motion-restraining projection 237 enhances the fixation of the columnar support portion 232 and thereby enhances the protection of the cartridge 100. The protection member 200A of the second embodiment has the similar functions and advantageous effects to those of the protection member 200 of the first embodiment.

Figure 15:
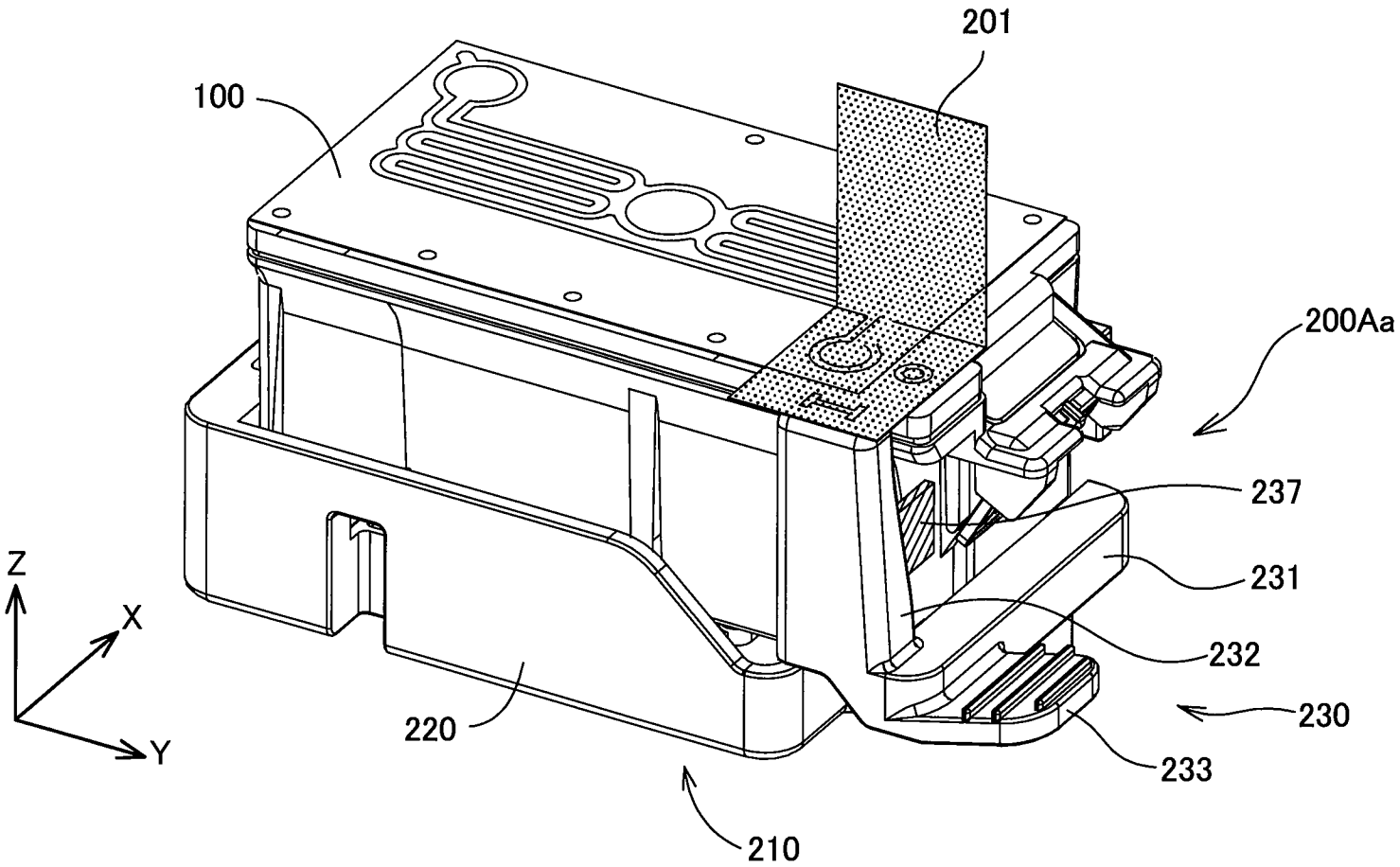
FIG. 15 is a schematic perspective view illustrating a protection member of another configuration example of the second embodiment.

FIG. 15 is a schematic perspective view illustrating a protection member 200Aa of another configuration example of the second embodiment. The protection member 200Aa of this configuration example has substantially the same structure as that of the protection member 200A described above, except the structure of the motion-restraining projection 237. The motion-restraining projection 237 of the protection member 200Aa is formed at a position opposed to the front surface 103 of the cartridge 100 such as to be engaged with the front surface 103 of the cartridge 100 in the state that the protection member 200Aa is attached to the cartridge 100. The protection member 200Aa of this configuration has the similar functions and advantageous effects to those of the protection member 200A described above.

C. Third Embodiment

Figure 16:
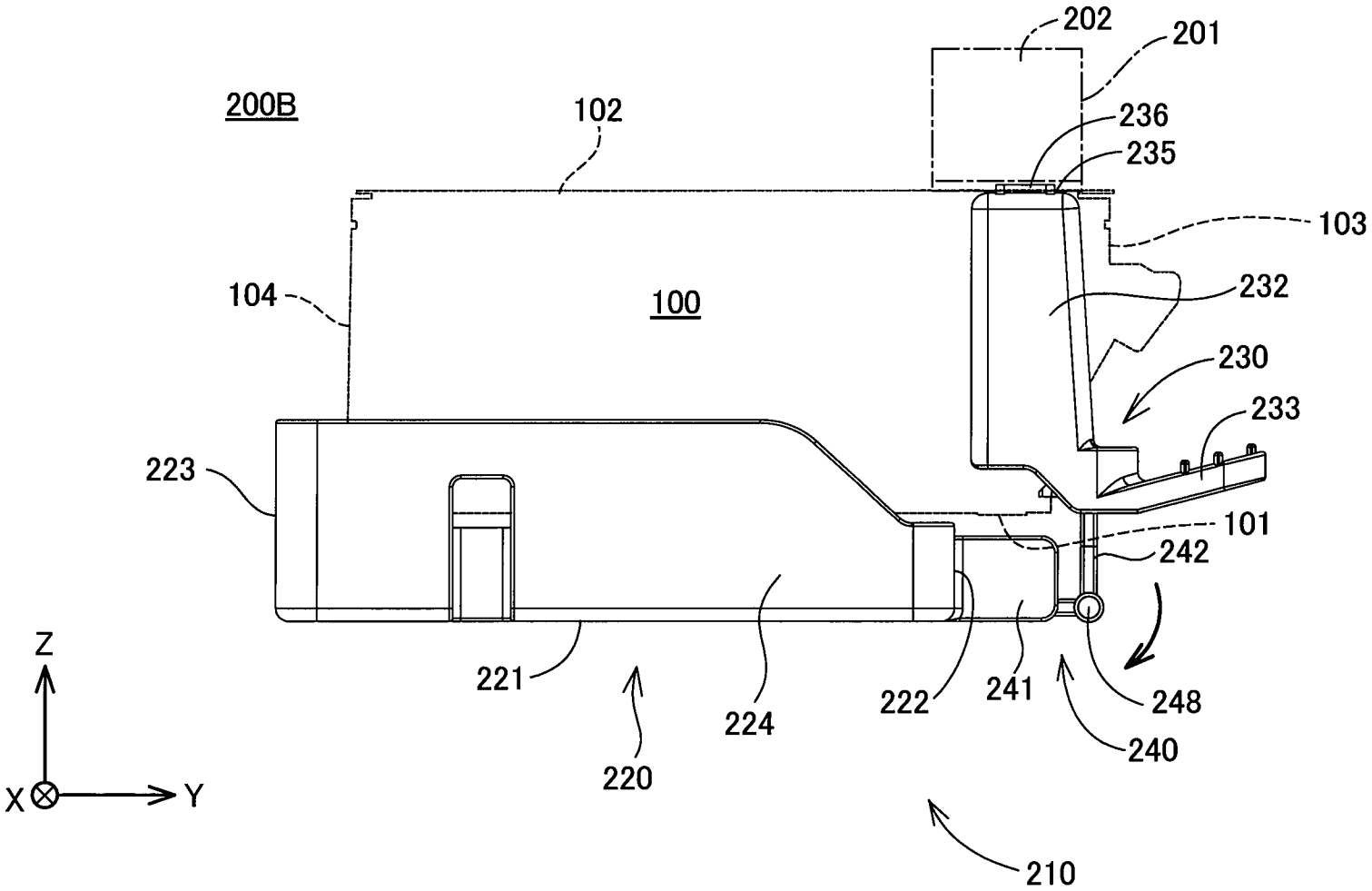
FIG. 16 is a schematic left side view illustrating a protection member according to a third embodiment.

FIG. 16 is a schematic left side view illustrating a protection member 200B according to a third embodiment of the invention. The protection member 200B of the third embodiment has substantially the same structure as that of the protection member 200 of the first embodiment, except that the connecting section 240 has a hinge mechanism 248 serving as the supporting point of the rotational motion of the front end wall section 230. In the protection member 200B of the third embodiment, the cap section 220 and the front end wall section 230 produced as separate components are connected with each other via the hinge mechanism 248 provided as the hinge structure of the connecting section 240. In the protection member 200B of the third embodiment, the hinge mechanism 248 enhances the stability of the rotational motion of the front end wall section 230. Additionally, the protection member 200B of the third embodiment has the structure corresponding to that of the protection member 200 of the first embodiment and thereby has the similar functions and advantageous effects to those of the protection member 200 of the first embodiment.

D. Fourth Embodiment

Figure 17:
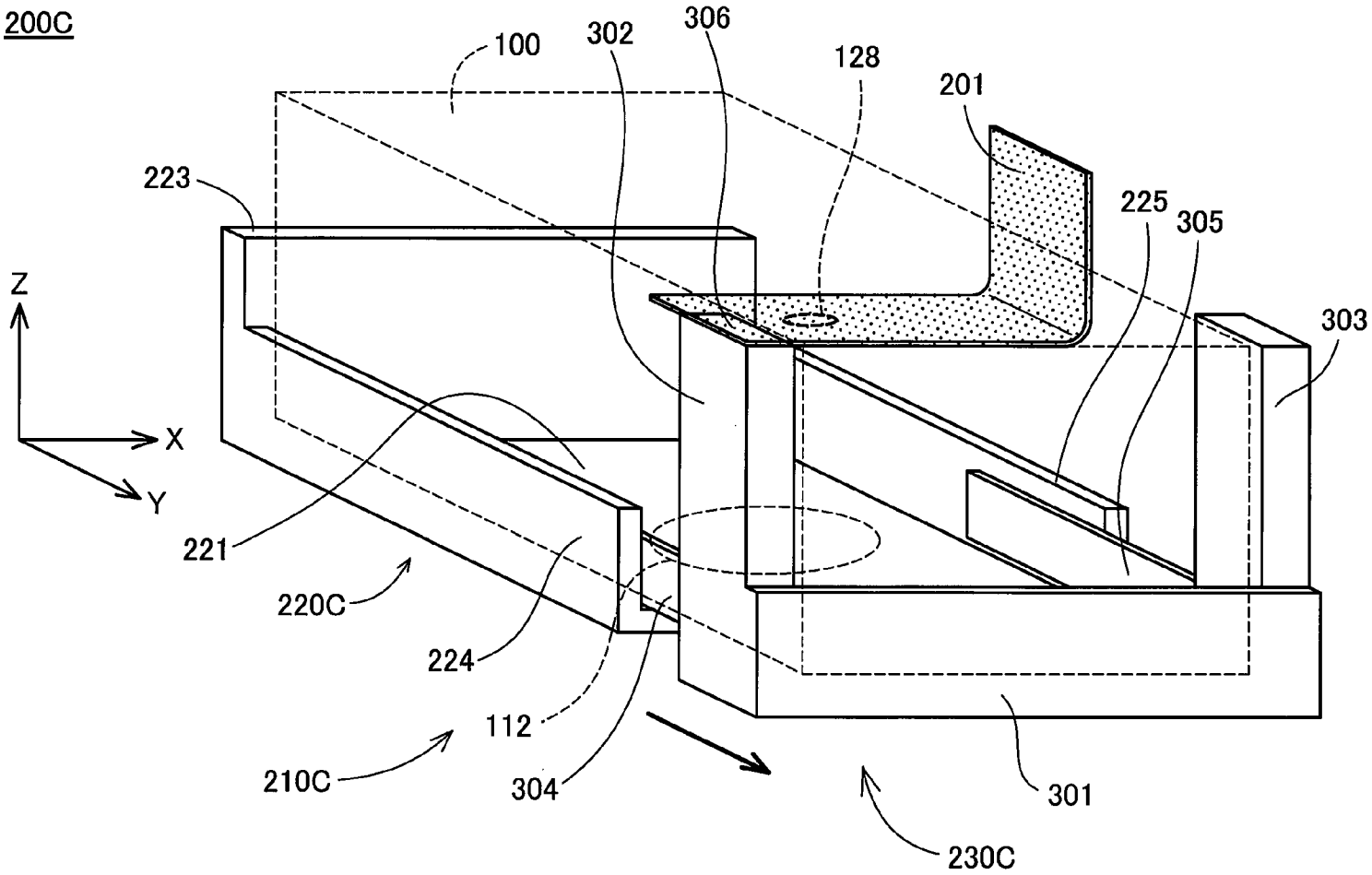
FIG. 17 is a schematic perspective view illustrating a protection member according to a fourth embodiment.

FIG. 17 is a schematic perspective view illustrating a protection member 200C according to a fourth embodiment of the invention. The contour of the outer circumference of the cartridge 100 is schematically shown by the broken line in FIG. 17. The protection member 200C of the fourth embodiment is attached to the cartridge 100 described in the first embodiment as shown in FIGS. 2 to 4. The protection member 200C of the fourth embodiment has a film member 201 and a holder structure 210C. The film member 201 has the similar structure to that described in the first embodiment.

The holder structure 210C has a cap section 220C and a front end wall section 230C. The cap section 220C has the similar structure to that of the cap section 220 of the first embodiment except omission of the front wall portion 222, and has the bottom wall portion 221, the rear wall portion 223, the left side wall portion 224 and the right side wall portion 225. The front end wall section 230C includes a front wall portion 301, a first columnar support portion 302, a second columnar support portion 303, a first rail portion 304 and a second rail portion 305.

The front wall portion 301 comes into contact with a lower edge of the front surface 103 of the cartridge 100 in the state that the protection member 200C is attached to the cartridge 100. Projections (illustration is omitted) to be fit in the respective fitting holes 113 of the cartridge 100 are provided on a surface of the front wall portion 301 that is in contact with the cartridge 100.

The first and the second columnar support portions 302 and 303 are respectively connected with left and right edges of the front wall portion 301. The first and the second columnar support portions 302 and 303 are extended in the direction of the arrow Z, such that upper end surfaces 306 of the first and the second columnar support portions 302 and 303 are located at substantially the same height positions as the height position of the top surface 102 of the cartridge 100. The first columnar support portion 302 is located in an area opposed to the left side surface 105 of the cartridge 100 in the state that the protection member 200C is attached to the cartridge 100. The film member 201 is welded to the upper end surface 306 of the first columnar support portion 302.

The first and the second rail portions 304 and 305 are respectively extended from the lower ends of the first and the second columnar support portions 302 and 303 into the area placed between the left side wall portion 224 and the right side wall portion 225 of the cap section 220C in such a manner as to be in contact with the left side wall portion 224 and the right side wall portion 225. The first and the second rail portions 304 and 305 restrict the motion of the front end wall section 230C with respect to the cap section 220C to only the linear motion along the direction of the arrow Y.

In the protection member 200C of the fourth embodiment, in the state that the protection member 200C is attached to the cartridge 100, the film member 201 restricts the linear motion of the front end wall section 230C in the direction away from the cartridge 100. Accordingly, the retained state that the cartridge 100 is retained in the holder structure 210C is not released unless the film member 201 is separated from the top surface 102 of the cartridge 100. This configuration suppresses the sealing of the ink supply port 112 from being released prior to release of the sealing of the air hole 128 in the course of detachment of the protection member 200C from the cartridge 100. Additionally, the protection member 200C of the fourth embodiment has the structure corresponding to that of the protection member 200 of the first embodiment and thereby has the similar functions and advantageous effects to those of the protection member 200 of the first embodiment.

E. Fifth Embodiment

Figure 18:
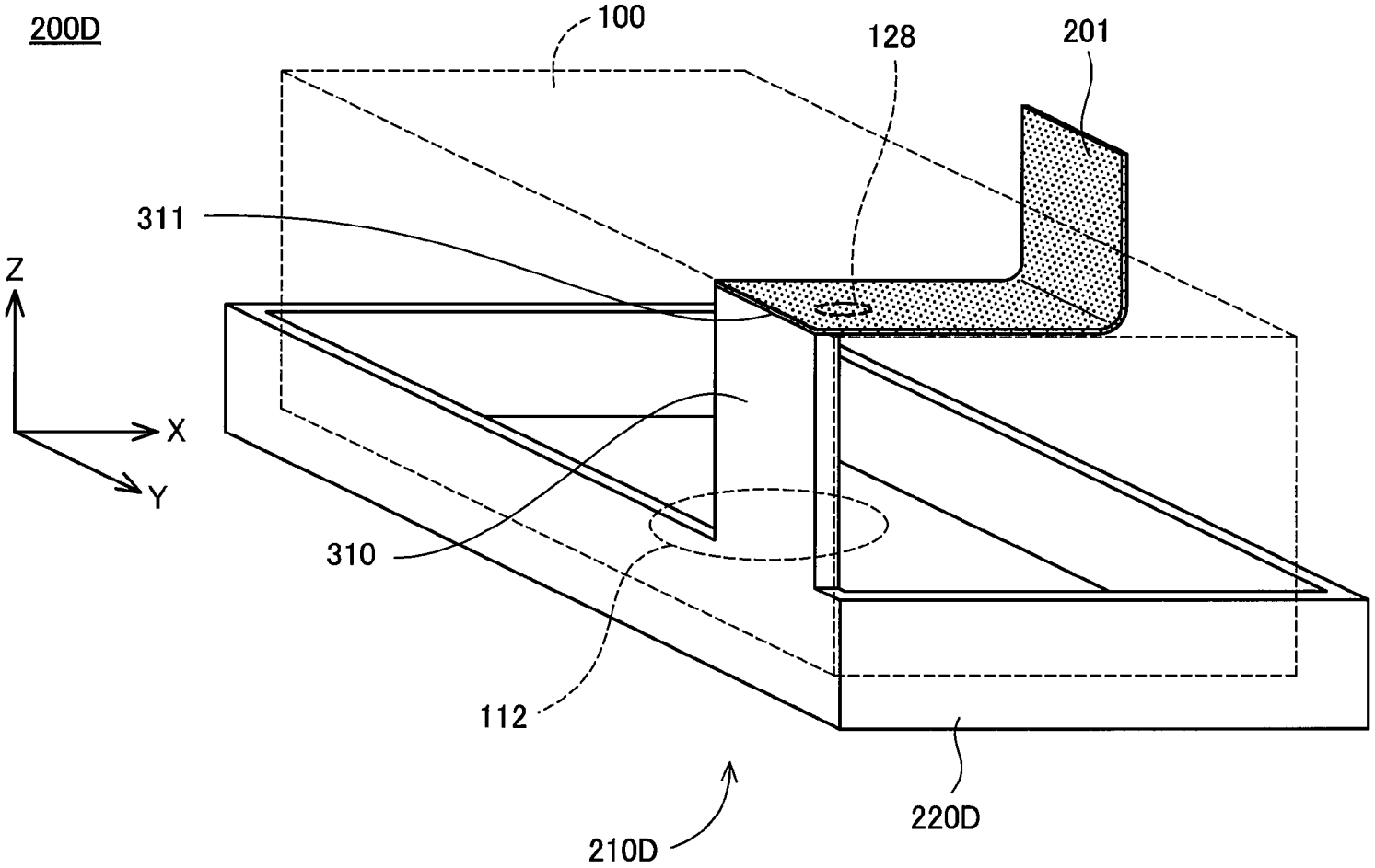
FIG. 18 is a schematic perspective view illustrating a protection member according to a fifth embodiment.

FIG. 18 is a schematic perspective view illustrating a protection member 200D according to a fifth embodiment of the invention. The contour of the outer circumference of the cartridge 100 is schematically shown by the broken line in FIG. 18. The protection member 200D of the fifth embodiment is attached to the cartridge 100 described in the first embodiment as shown in FIGS. 2 to 4. The protection member 200D of the fifth embodiment has a film member 201 and a holder structure 210D. The film member 201 has the similar structure to that described in the first embodiment.

The holder structure 210D includes a cap section 220D and an extended section 310. The cap section 220D is formed in a box shape having an upper opening and receives the lower end part of the cartridge 100 fit therein to cover the entire lower end part of the cartridge 100. The cap section 220D has a seal member, which is not illustrated in the figures, provided to seal the ink supply port 112 of the cartridge 100.

The extended section 310 is extended from an end of the cap section 220D in the direction of the arrow Z in an area opposed to the left side surface 105 of the cartridge 100. The extended section 310 has an upper end portion 311 located at substantially the same height position as the height position of the top surface 102 of the cartridge 100 and arranged to be adjacent to the air hole 128 of the cartridge 100 in the direction of the arrow X. The film member 201 is welded to the upper end portion 311 of the extended section 310.

In the protection member 200D of the fifth embodiment, the motion of the extended section 310 is restricted unless the film member 201 is separated from the top surface 102 of the cartridge 100. This restricts the operation of demounting the cap section 220D from the lower end part of the cartridge 100. The protection member 200D of the fifth embodiment having the simpler configuration suppresses the sealing of the ink supply port 112 from being released prior to release of the sealing of the air hole 128 in the course of detachment of the protection member 200D from the cartridge 100. Additionally, the protection member 200D of the fifth embodiment has the structure corresponding to that of the protection member 200 of the first embodiment and thereby has the similar functions and advantageous effects to those of the protection member 200 of the first embodiment.

F. Modifications

F1. Modification 1

In the protection member 200 of the first embodiment described above, the tape-shaped film member 201 is used as the seal member to seal the air hole 128. The seal member may, however, have another structure. For example, the seal member may include a cap section configured to seal the air hole 128 and a string section disposed between the cap section and the upper end surface 235 of the columnar support portion 232. In this modification, it is desirable to stretch the string section between the air hole 128 and the upper end surface 235 of the columnar support portion 232 with a certain tension, such as to restrict the motion of the columnar support portion 232.

F2. Modification 2

In the protection member 200 of the first embodiment described above, the supporting structure which the film member 201 is joined with is the columnar support portion 232 in the columnar shape extended straight upward. The supporting structure which the film member 201 is joined with is, however, not limited to the columnar support portion 232. For example, the supporting structure may be a member having a bent area or may be a wall-shaped member.

F3. Modification 3

In the protection member 200 of the first embodiment, the columnar support portion 232 is located in the area FA opposed to the left side surface 105 of the cartridge 100 in the state that the protection member 200 is attached to the cartridge 100. The columnar support portion 232 may, however, be located in an area opposed to the right side surface 106 of the cartridge 100. The columnar support portion 232 may not be entirely located in the area FA opposed to the left side surface 105 of the cartridge 100 but may be partly located in an area opposed to the front surface 103, the rear surface 104 or the bottom surface 101 of the cartridge 100. The columnar support portion 232 may not be arranged to directly face the left side surface 105 of the cartridge 100, but another member such as a buffer material may be placed between the columnar support portion 232 and the cartridge 100.

F4. Modification 4

In the protection member 200 of the first embodiment described above, the cap section 220 has the five wall portions 221 to 225. The cap section 220 may, however, not necessarily have all the five wall portions 221 to 225. The cap section 220 is needed to have at least an area for sealing the ink supply port 112.

F5. Modification 5

The protection member 200 of the first embodiment described above is configured to be attachable to the cartridge 100. The Protection member 200 may, however, be configured to be attachable to another cartridge having another structure. The protection member 200 may be configured to be attachable to a cartridge having a plurality of air holes 128 and a plurality of ink supply ports 112 and may have film members 201 and seal members 250 provided corresponding to the respective air holes 128 and the ink supply ports 112. The protection member 200 may be configured to be attachable to a cartridge without the circuit substrate 135 or the ribs 119. The cartridge 100 which the protection member 200 is attached to may be a hexahedron in an approximately trapezoidal shape viewed in the direction of the arrow X or may be a substantially circular disk in an approximately elliptical shape in the side view. The respective surfaces 101 to 106 forming the outer surfaces of the cartridge 100 may not be necessarily flat surfaces or smooth surfaces but may have concavities and convexities. These surfaces 101 to 106 may not be extended as substantially flat surfaces but may have some cuts or cracks. The respective wall surfaces 101 to 106 may be bent to form curved surfaces. Additionally, for example, the front surface 103 and the left side surface 105 may not intersect with each other but may be arranged to be adjacent to each other and form a continuous curved surface. In another example, the front surface 103 and the left side surface 105 may be arranged to be adjacent to each other across a small chamfered area. The respective wall surfaces 101 to 106 may have flexibility and may be arranged to form a casing of frames and hold a bag-shaped member containing ink in the frame.

F6. Modification 6

The protection member 200 of the first embodiment described above has the fitting projections 234 and the extension 226 to be engaged with the cartridge 100. The fitting projections 234 and the extension 226 may, however, be omitted.

F7. Modification 7

In the protection member 200 of the first embodiment described above, the operating portion 233 for rotational motion of the front end wall section 230 is provided at the position close to the columnar support portion 232. The operating portion 233 may, however, be provided at a position away from the columnar support portion 232 or may be omitted from the front end wall section 230.

F8. Modification 8

In the protection member 200 of the first embodiment described above, the holder structure 210 is produced by integrally molding the cap section 220, the front end wall section 230 and the connecting section 240. Alternatively, the holder structure 210 may be produced by assembling the respective sections produced individually.

The invention is not limited to any of the embodiments, the examples and the modifications described herein but may be implemented by a diversity of other configurations without departing from the scope of the invention. For example, the technical features of the embodiments, examples or modifications corresponding to the technical features of the respective aspects described in Summary may be replaced or combined appropriately, in order to solve part or all of the problems described above or in order to achieve part or all of the advantageous effects described above. Any of the technical features may be omitted appropriately unless the technical feature is described as essential herein.

The invention claimed is:

1. A protection member configured to be attachable to a liquid supply unit, the liquid supply unit comprising a first wall surface, a second wall surface opposed to the first wall surface, a third wall surface arranged between the first wall surface and the second wall surface, and a fourth wall surface arranged between the first wall surface and the second wall surface to be adjacent to the third wall surface, wherein the first wall surface has a liquid supply port through which a liquid is flowed, the second wall surface has an air hole through which air is flowed, and the fourth wall surface has an engagement structure, the protection member comprising:

a cap member configured to seal the liquid supply port; and a seal member configured to seal the air hole, the cap member including a supporting structure including a joint part which the seal member is joined with, and the protection member configured and adapted such that at least part of the supporting structure being provided in an area opposed to the third wall surface in a state that the protection member is attached to the liquid supply unit the cap member comprising:

a sealing wall section configured to have a sealing element arranged to seal the liquid supply port;

an end wall configured to have the supporting structure and arranged to be in contact with the fourth wall surface of the liquid supply unit in the state that the protection member is attached to the liquid supply unit; and a connecting section configured to connect the sealing wall section with the end wall and serve as a supporting point of rotational motion of the end wall in a direction away from the fourth wall surface, and the supporting structure is adapted to rotate with the end wall.

2. The protection member according to claim 1, the cap member comprising:

a first side wall arranged to intersect with the sealing wall section and to be in contact with the third wall surface of the liquid supply unit in the state that the protection member is attached to the liquid supply unit; and a second side wall arranged to intersect with the sealing wall section and to be opposed to the first side wall, the end wall and the first side wall being away from each other across a first interval, and the end wall and the second side wall being away from each other across a second interval.

3. The protection member according to claim 1,
the end wall being defined as a first end wall, and
the cap member comprising a second end wall located at a position opposed to the first end wall across the sealing wall section,
in a plan view of the protection member in a direction toward the sealing wall section, with respect to a direction from the first end wall toward the second end wall, a distance La from the joint part of the supporting structure to the second end wall and a distance Lb from the connecting section to the second end wall satisfying a relation of La≥Lb.

4. The protection member according to claim 1,
in a plan view of the protection member in a direction toward the third wall surface in the state that the protection member is attached to the liquid supply unit,
an angle Θ of a direction from the supporting point of the rotational motion of the end wall toward the joint part with respect to the sealing wall section being in a range of 70 degrees≤Θ≤110 degrees.

5. The protection member according to claim 4, the angle Θ being in a range of 80 degrees≤Θ≤100 degrees.

6. The protection member according to claim 1,
the end wall comprising:
an engaged element to be engaged with the engagement structure; and
an operating portion configured to change positions of the engaged element and the supporting structure relative to the liquid supply unit.

7. The protection member according to claim 6,
in a plan view of the protection member in a direction toward the end wall, the operating portion being formed at a position offset to the supporting structure side.

8. The protection member according to claim 6,
a distance from the connecting section to the joint part being longer than a distance from the connecting section to the operating portion.

9. The protection member according to claim 7,
a distance from the connecting section to the joint part being longer than a distance from the connecting section to the operating portion.

10. The protection member according to claim 6,
in a direction of attachment of the protection member to the liquid supply unit, a distance from the sealing wall section to the operating portion being longer than a distance from the sealing wall section to the engaged element and is shorter than a distance from the sealing wall section to the joint part.

11. The protection member according to claim 7,
in a direction of attachment of the protection member to the liquid supply unit, a distance from the sealing wall section to the operating portion being longer than a distance from the sealing wall section to the engaged element and is shorter than a distance from the sealing wall section to the joint part.

12. The protection member according to claim 8,
in a direction of attachment of the protection member to the liquid supply unit, a distance from the sealing wall section to the operating portion being longer than a distance from the sealing wall section to the engaged element and is shorter than a distance from the sealing wall section to the joint part.

13. The protection member according to claim 9,
in a direction of attachment of the protection member to the liquid supply unit, a distance from the sealing wall section to the operating portion being longer than a distance from the sealing wall section to the engaged element and is shorter than a distance from the sealing wall section to the joint part.

14. The protection member according to claim 1,
the connecting section including a hinge structure to rotate the end wall.

15. The protection member according to claim 1,
Wherein the end wall protrudes from an area facing the fourth wall surface toward the third wall surface-side and is connected to the supporting structure.

16. The protection member according to claim 1,
wherein the supporting structure has a columnar shape which extends in a direction toward the second wall surface from the first wall surface, and the connecting section is provided on an upper end of the supporting structure.

* * * * *